US011196184B2

(12) United States Patent
Jordan et al.

(10) Patent No.: US 11,196,184 B2
(45) Date of Patent: Dec. 7, 2021

(54) BROADBAND ANTENNA ARRAY

(71) Applicant: Cubic Corporation, San Diego, CA (US)

(72) Inventors: Jared W Jordan, Raleigh, NC (US); Kenneth J Vanhille, Cary, NC (US); Timothy A Smith, Durham, NC (US); William Stacy, Blacksburg, VA (US); Benjamin L Cannon, Apex, NC (US); David W Sherrer, Cary, NC (US)

(73) Assignee: Cubic Corporation, San Diego, CA (US)

( * ) Notice: Subject to any disclaimer, the term of this patent is extended or adjusted under 35 U.S.C. 154(b) by 55 days.

(21) Appl. No.: 16/076,354

(22) PCT Filed: Jun. 19, 2018

(86) PCT No.: PCT/US2018/038214
§ 371 (c)(1),
(2) Date: Aug. 8, 2018

(87) PCT Pub. No.: WO2018/236821
PCT Pub. Date: Dec. 27, 2018

(65) Prior Publication Data

US 2021/0203085 A1 Jul. 1, 2021

Related U.S. Application Data

(60) Provisional application No. 62/614,636, filed on Jan. 8, 2018, provisional application No. 62/522,258, filed on Jun. 20, 2017.

(51) Int. Cl.
*H01Q 25/00* (2006.01)
*H01Q 9/06* (2006.01)
(Continued)

(52) U.S. Cl.
CPC ..... *H01Q 25/001* (2013.01); *H01Q 5/25* (2015.01); *H01Q 5/48* (2015.01); *H01Q 9/065* (2013.01);
(Continued)

(58) Field of Classification Search
CPC .. H01Q 25/001; H01Q 13/085; H01Q 21/062; H01Q 21/064; H01Q 21/24;
(Continued)

(56) References Cited

U.S. PATENT DOCUMENTS 3,157,847 A 11/1964 Williams
3,618,105 A 11/1971 Bruene
(Continued)

FOREIGN PATENT DOCUMENTS

JP 2008283012 11/2008
JP 2008307737 12/2008
(Continued)

OTHER PUBLICATIONS

The ARRL Atenna Book, by Gerald Hall (Year: 1988).
(Continued)

*Primary Examiner* — Vibol Tan
(74) *Attorney, Agent, or Firm* — Kilpatrick Townsend & Stockton, LLP

(57) ABSTRACT

Antenna arrays, including a broadband single or dual polarized, tightly coupled radiator arrays.

25 Claims, 35 Drawing Sheets

(51) Int. Cl.

| | |
|---|---|
| ***H01Q 21/24*** | (2006.01) |
| ***H01Q 21/06*** | (2006.01) |
| ***H01Q 21/00*** | (2006.01) |
| ***H01Q 13/08*** | (2006.01) |
| ***H01Q 5/25*** | (2015.01) |
| ***H01Q 9/28*** | (2006.01) |
| ***H01Q 5/48*** | (2015.01) |
| *H01Q 1/40* | (2006.01) |

(52) U.S. Cl.
CPC ..... *H01Q 9/285* (2013.01); *H01Q 13/085* (2013.01); *H01Q 21/0093* (2013.01); *H01Q 21/062* (2013.01); *H01Q 21/064* (2013.01); *H01Q 21/24* (2013.01); *H01Q 1/40* (2013.01)

(58) Field of Classification Search
CPC ..... H01Q 9/065; H01Q 21/0093; H01Q 1/04; H01Q 9/285; H01Q 15/14; H01Q 19/108; H01Q 21/0006; H01Q 21/065; H01Q 5/25; H01Q 5/48; H01Q 5/00; H01Q 5/30; H01Q 9/0407; H01Q 9/045
See application file for complete search history.

(56) References Cited

U.S. PATENT DOCUMENTS

| | | | | |
|---|---|---|---|---|
| 3,820,041 | A | 6/1974 | Gewartowski | |
| 4,218,685 | A | 8/1980 | Frosch | |
| 4,647,942 | A | 3/1987 | Counselman, III | |
| 4,677,393 | A | 6/1987 | Sharma | |
| 4,994,817 | A | 2/1991 | Munson | |
| 5,405,267 | A | 4/1995 | Koegel | |
| 5,557,291 | A | 9/1996 | Chu | |
| 6,101,705 | A | 8/2000 | Wolfson | |
| 6,238,218 | B1 | 5/2001 | Jean-Marc | |
| 6,317,099 | B1 | 11/2001 | Zimmerman | |
| 6,323,809 | B1 | 11/2001 | Maloney | |
| 6,356,241 | B1 | 3/2002 | Jaeger | |
| 6,512,487 | B1 | 1/2003 | Taylor | |
| 6,842,158 | B2 | 1/2005 | Jo | |
| 7,079,079 | B2 | 7/2006 | Jo | |
| 7,109,936 | B2 | 9/2006 | Mizoguchi | |
| 7,463,210 | B2 | 12/2008 | Rawnick | |
| 7,764,236 | B2 | 7/2010 | Mill | |
| 7,889,147 | B2 | 2/2011 | Tam | |
| 7,948,335 | B2 | 5/2011 | Sherrer | |
| 8,325,093 | B2 * | 12/2012 | Holland | H01Q 9/285 343/700 MS |
| 9,130,262 | B2 | 9/2015 | Park | |
| 9,306,254 | B1 | 4/2016 | Hovey | |
| 10,008,779 | B2 | 6/2018 | Boryssenko | |
| 10,784,588 | B2 * | 9/2020 | Svensson | H01Q 1/22 |
| 10,971,802 | B2 * | 4/2021 | Kim | H01Q 21/0075 |
| 10,978,813 | B2 * | 4/2021 | Yang | H01Q 5/25 |
| 2003/0231134 | A1 | 12/2003 | Yarasi | |
| 2004/0119557 | A1 | 6/2004 | Barnes | |
| 2004/0263410 | A1 | 12/2004 | Teillet | |
| 2005/0013977 | A1 | 1/2005 | Wong | |
| 2005/0040994 | A1 | 2/2005 | Mazoki | |
| 2005/0116862 | A1 | 6/2005 | du Toit | |
| 2006/0232489 | A1 | 10/2006 | Bisiules | |
| 2007/0126651 | A1 | 6/2007 | Snyder | |
| 2008/0074339 | A1 | 3/2008 | Lee | |
| 2008/0079644 | A1 | 4/2008 | Cheng | |
| 2009/0051619 | A1 | 2/2009 | Anders | |
| 2009/0284419 | A1 | 11/2009 | Kim | |
| 2010/0007572 | A1 | 1/2010 | Jones | |
| 2011/0025574 | A1 | 2/2011 | Tiezzi | |
| 2011/0057852 | A1 | 3/2011 | Holland | |
| 2012/0146869 | A1 | 6/2012 | Holland | |
| 2013/0002501 | A1 | 1/2013 | Li | |
| 2013/0169505 | A1 | 7/2013 | Shmuel | |
| 2014/0103423 | A1 | 4/2014 | Ohlsson | |
| 2014/0354500 | A1 | 12/2014 | Tayama | |
| 2015/0162665 | A1 | 6/2015 | Boryssenko | |
| 2016/0268695 | A1 | 9/2016 | Zavrel, Jr. | |
| 2016/0294035 | A1 | 10/2016 | Jean-Marc | |
| 2016/0370568 | A1 | 12/2016 | Toussaint | |
| 2017/0025767 | A1 | 1/2017 | Elsallal | |
| 2017/0170592 | A1 | 6/2017 | Sherrer | |
| 2017/0256859 | A1 | 9/2017 | Boryssenko | |
| 2017/0331199 | A1 * | 11/2017 | Svensson | H01Q 13/106 |
| 2018/0323510 | A1 | 11/2018 | Boryssenko | |

FOREIGN PATENT DOCUMENTS

| | | |
|---|---|---|
| WO | 2007076105 | 7/2007 |
| WO | 2014011675 | 1/2014 |

OTHER PUBLICATIONS

Office Action dated Nov. 8, 2018 for U.S. Appl. No. 15/373,016 (pp. 1-20).

Ghannoum, H. et al. "Probe Fed Stacked Patch Antenna for UWB Sectoral Applications," IEEE International Conference on Ultra-Wideband 2005. pp. 97-102.

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

Gao, S. et al. "A Broad-Band Dual-Polarized Microstrip Patch AntennaWith Aperture Coupling," IEEE Transactions on Antennas and Propagation, vol. 51, No. 4, Apr. 2003. pp. 898-900.

Gao, S.C., et al., Dual-polarised Wideband Microstrip Antenna, Electronic Letters, Aug. 30, 2001, vol. 37, No. 18, pp. 1106-1107.

Guo, Y.X et al. "L-probe proximity-fed short-circuited patch antennas," Electronics Letters, vol. 35 No. 24, Nov. 25, 1999. pp. 2069-2070.

H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.

H. Zhou, N. A. Sutton, D. S. Filipovic, "Wideband W-band patch antenna," 5th European Conference on Antennas and Propagation , Rome, Italy, Apr. 2011, pp. 1518-1521.

Holzheimer, et al., Performance Enhancements with Applications of the Coaxial Cavity Antenna, pp. 171-193.

Hsu, Wen-Hsiu et al. "Broadband Aperture-Coupled Shorted-Patch Antenna," Microwave and Optical Technology Letters, vol. 28, No. 5, Mar. 5, 2001. pp. 306-307.

J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.

J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.

J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.

(56) References Cited

OTHER PUBLICATIONS

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
K. Vanhille, M. Lukic, S. Rondineau, D. Filipovic, and Z. Popovic, "Integrated microcoaxial passive components for millimeter-wave antenna front ends," 2007 Antennas, Radar, and Wave Propagation Conference, May 2007.
L. Ranzani, N. Ehsan, Z. Popovic, "G-band frequency-scanned antenna arrays," 2010 IEEE APS-URSI International Symposium, Toronto, Canada, Jul. 2010.
M. Lukic, D. Fontaine, C. Nichols, D. Filipovic, "Surface micromachined Ka-band phased array antenna," Presented at Antenna Applic. Symposium, Monticello, IL, Sep. 2006.
M. Lukic, K. Kim, Y. Lee, Y. Saito, and D. S. Filipovic, "Multiphysics design and performance of a surface micromachined Ka-band cavity backed patch antenna," 2007 SBMO/IEEE Int. Microwave and Optoelectronics Conf., Oct. 2007, pp. 321-324.
M. V. Lukic, and D. S. Filipovic, "Integrated cavity-backed ka-band phased array antenna," Proc. IEEE-APS/URSI Symposium, Jun. 2007, pp. 133-135.
M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.
Mruk, J.R., Saito, Y., Kim, K., Radway, M., Filipovic, D.S., "Directly fed millimetre-wave two-arm spiral antenna," Electronics Letters, Nov. 25, 2010, vol. 46 , issue 24, pp. 1585-1587.
N. Chamberlain, M. Sanchez Barbetty, G. Sadowy, E. Long, K. Vanhille, "A dualpolarized metal patch antenna element for phased array applications," 2014 IEEE Antenna and Propagation Symposium, Memphis, Jul. 2014. pp. 1640-1641.
N. Jastram, D. S. Filipovic, "Parameter study and design of W-band micromachined tapered slot antenna," Proc. IEEE-APS/URSI Symposium, Orlando, FL, Jul. 2013, pp. 434-435.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.
Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.
Oliver, J.M et al., "A 3-D micromachined W-band cavity backed patch antenna array with integrated rectacoax transition to wave guide," 2009 Proc. IEEE International Microwave Symposium, Boston, MA 2009.
Sevskiy, S. and Wiesbeck, W., "Air-Filled Stacked-Patch Antenna," ITG-Fachberichte. No. 178, (2003). pp. 53-56.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
Tim Holzheimer, Ph.D., P.E., The Low Dispersion Coaxial Cavity as an Ultra Wideband Antenna, 2002 IEEE Conference on Ultra Wideband Systems and Technologies, pp. 333-336.
Vallecchi, A. et al. "Dual-Polarized Linear Series-Fed Microstrip ArraysWith Very Low Losses and Cross Polarization," IEEE Antennas and Wireless Propagation Letter, vol. 3, 2004. pp. 123-126.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Zurcher, J. "Broadband Patch Antennas," Chapters, 1995. pp. 45-61.
Ben Munk et al.; "A Low-Profile Broadband Phased Array Antenna"; The Ohio State University ElectroScience Laboratory, Dept. of Electrical Engineering; 2003 pp. 448-451.
Woorim Shin, et al. "A 108-114 GHz 4 4 Wafer-Scale Phased Array Transmitter With High-Efficiency On-Chip Antennas"; IEEE Journal of Solid-State Circuits, vol. 48, No. 9, Sep. 2013.
Harold A. Wheeler; "Simple Relations Derived from a Phased-Array Antenna Made of an Infinite Current Sheet"; IEEE Transactions on Antennas Propagation; Jul. 1965; pp. 506-514.
E. G. Magill, et al.; Wide-Angle Impedance Matching of a Planar Array Antenna by a Dielectric Sheet; IEEE Transactions on Antennas Propagation; Jan. 1966; vol. AP-14 No. 1; pp. 49-53.
P. W. Hannan, et al.; Impedance Matching a Phased-Array Antenna Over Wide Scan Angles by Connecting Circuits; Impedance Matching a Phased-Array Antenna; Jan. 1965 pp. 28-34.
James E. Dudgeon, et al.;Microstrip Technology and Its Application to Phased Array Compensation; Jan. 21, 1972; pp. 1-81.
Kerry Speed, et al.; Progress on the 8-40 GHz Wideband Instrument for Snow Measurements(WISM); Harris.com Earth Science Tech nology Forum 2014 Oct. 28-30, 2014 Leesburg, VA; pp. 1-36.
Mark Jones, et al.; A New Approach To Broadband Array Design Using Tightly Coupled Elements; IEEE; 2007; pp. 1-7.
W. M. Qureshi,, et al., Fabrication of a Multi-Octave Phased Array Aperture; 6th EMRS DTC Technical Conference—Edinburgh; 2009; pp. 1-5.
John Forrest McCann, B.S.; On the Design of Large Bandwidth Arrays of Slot Elements With Wide Scan Angle Capabilities; Thesis the Ohio State University; 2006; pp. 1-102.
Tengfei Xia,, et al.; Design of a Tapered Balun for Broadband Arrays With Closely Spaced Elements; IEEE Antennas and Wireless Propagation Letters, vol. 8, 2009; pp. 1291-1294.
Justin A. Kasemodel, et al.; A Miniaturization Technique for Wideband Tightly Coupled Phased Arrays; IEEE; 2009; pp. 1-4.
Elias A. Alwan,, Et al.; A Simple Equivalent CircuitModel for Ultrawideband Coupled Arrays; IEEE Antennas and Wireless Propagation Letters, vol. 11, 2012; pp. 117-120.
Nathanael J. Smith; Development of a 180° Hybrid Balun to Feed a Tightly Coupled Dipole X-Band Array; The Ohio State University 2010; pp. 1-52.
Justin A. Kasemodel; Realization of a Planar Low-Profile Broadband Phased Array Antenna; Dissertation, The Ohio State University 2010; pp. 1-120.
Justin A. Kasemodel, et al.; Low-Cost, Planar and Wideband Phased Array with Integrated Balun and Matching Network for Wide-Angle Scanning; IEEE 2010; pp. 2-4.
Erdinc Irci; Low-Profile Wideband Antennas Based on Tightly Coupled Dipole and Patch Elements; Dissertation, The Ohio State University 2011; pp. 1-126.
William F. Moulder; Novel Implementations of Ultrawideband Tightly Coupled Antenna Arrays; Dissertation, The Ohio State University 2012; pp. 1-133.
Ioannis Tzanidis; Ultrawideband Low-Profile Arrays of Tightly Coupled Antenna Elements: Excitation, Termination and Feeding Methods; Dissertation, The Ohio State University 2011; pp. 1-189.
Jonathan Doane; Wideband Low-Prole Antenna Arrays: Fundamental Limits and Practical Implementations; Dissertation, The Ohio State University 2013; pp. 1-265.
Justin A. Kasemodel et al.; Wideband Planar Array With Integrated Feed and Matching Network for Wide-Angle Scanning; IEEE Transactions on Antennas and Propagation, vol. 61, No. 9, Sep. 2013; pp. 4528-4537.
Jonathan P. Doane, et al.; Wideband, Wide Scanning Conformal Arrays with Practical Integrated Feeds; Proceedings of the "2013 International Symposium on Electromagnetic Theory"; pp. 859-862.

(56) References Cited

OTHER PUBLICATIONS

Steven S. Holland, et al.; Design and Fabrication of Low-Cost PUMA Arrays; IEEE; 2011; pp. 1976-1979.
Steven S. Holland; Low-Profile, Modular, Ultra-Wideband Phased Arrays; Dissertation, University of Massachusetts; Sep. 2011; pp. 1-327.
John T. Logan, et al.; A Review of Planar Ultrawideband Modular Antenna (PUMA) Arrays; Proceedings of the "2013 International Symposium on Electromagnetic Theory"; 2013; pp. 868-871.
D. Cavallo, et al.; Common-Mode Resonances in Ultra Wide Band Connected Arrays of Dipoles: Measurements from the Demonstrator and Exit Strategy; IEEE; 2009; pp. 435-438.
J. J. Lee, et al.; Performance of a Wideband (3-14 GHz) Dual-pol Array; IEEE; 2004; pp. 551-554.
Jian Bai, et al.; Ultra-wideband Slot-loaded Antipodal Vivaldi Antenna Array; IEEE; 2011; pp. 79-81.
E. Garca I, et al.; Elimination of Scan Impedance Anomalies In Ultra-Wide Band Phased Arrays of Differentially Fed Tapered Slot Antenna Elements; IEEE; 2008; pp. 1-4.
Eloy de Lera Acedo, et al.; Study and Design of a Differentially-Fed Tapered Slot Antenna Array; IEEE Transactions on Antennas and Propagation, vol. 58, No. 1, Jan. 2010; pp. 68-78.
Y. Chen, et al.; A Novel Wideband Antenna Array With Tightly Coupled Octagonal Ring Elements; Progress In Electromagnetics Research, vol. 124, 55-70; 2012.
J. Y. Li; Design of Broadband Compact Size Antenna Comprised of Printed Planar Dipole Pairs; Progress in Electromagnetics Research Letters, vol. 12, 99-109; 2009.
Mats Gustafsson; Broadband array antennas using a self-complementary antenna array and dielectric slabs; CODEN:LUTEDX/(TEAT-7129)/1-8; Dec. 13, 2004.
Terry Richard Vogler; Analysis of the Radiation Mechanisms in and Design of Tightly-Coupled Antenna Arrays; Dissertation, Virginia Polytechnic Institute and State University; Sep. 10, 2010; pp. 1-251.
S. G. Hay, et al.; Analysis of common-mode effects in a dual-polarized planar connected-array antenna; Radio Science, vol. 43, RS6S04, doi:10.1029/2007RS003798; 2008.
A. Chippendale,, et al.; Chequerboard Phased Array Feed Testing for ASKAP; May 3, 2010; pp. 1-41.
Yan Fei, et al.; A Simple Wideband Dual-Polarized Array With Connected Elements; University of Electronic Science and Technology of China (UESTC); 2013; pp. 1-21.
Fei Yan, et al. ; A Simple Wideband Dual-Polarized Array With Connected Elements; Institute of Applied Physics and Computational Mathematics; 978-1-4673-5317-5/13 2013 IEEE.
Tomasz Michna, et al.; Characterization of an Impulse-Transmitting UWB Antenna Array with Dispersive Feed Network; Characterization of an Impulse-Transmitting UWB; 2008; pp. 59-62. Antenna Array with Dispersive Feed Network.
Martin Wagner, et al.; Multi-B and Polarizat ion-Ver satile Array Antenna for Smart Antenna Applications in Cellular Systems; 2004 EEE MTT-S Digest; pp. 1769-1772.
Jeremie Bourqui, et al.; Balanced Antipodal Vivaldi Antenna With Dielectric Director for Near-Field Microwave Imaging; EEE Transactions on Antennas and Propagation, vol. 58, No. 7; Jul. 2010.
R.N. Simons, et al.; Impedance matching of tapered slot antenna using a dielectric transformer; Electronics Letters Nov. 26, 1998 vol. 34 No. 24.
S. A. Adamu, et al.; Review on Gain and Directivity Enhancement Techniques of Vivaldi Antennas; International Journal of Scientific & Engineering Research, vol. 8, Issue 3, Mar. 2017; ISSN 2229-5518.
S. Livingston, et al.; Evolution of Wide Band Array Designs; 2011; IEEE p. 1957-1960.
J. J. Lee,W et al.; Wide Band Long Slot Array Antennas; IEEE; 2003; pp. 452-455.
Johnson J. H. Wang; A New Planar Multioctave Broadband Traveling-Wave Beam-Scan Array Antenna; Wang Electro-Opto Corporation; 2007; pp. 1-4.
John Toon; New planar design allows fabrication of ultra-wideband, phased-array antennas; 100-to-1 Bandwidth @ Winter 2006; pp. 18-19.
Hans Steyskal, et al.; Design of Realistic Phased Array Patch Elements Using a Genetic Algorithm; Air Force Research Laboratory; 2010; pp. 246-252.
Benjamin Riviere, et al.; Ultrawideband Multilayer Printed Antenna Arrays With Wide Scanning Capability; 2015; IEEE; 514-515.
Boryssenko, et al.; A Matlab Based Universal CEM CAD Optimizer; 2012; IEEE International Symposium on Antennas and Propagation; pp. 1-25.
Justin A. Kasemodel, et al.; A Novel Non-Symmetric Tightly Coupled Element for Wideband Phased Array Apertures; Dissertation the Ohio State University; 2010; pp. 1-13.
Markus H. Novak, et al.; Ultra-Wideband Phased Array Antennas for Satellite Communications up to Ku- and Ka-Band; May 2015; pp. 1-6.
Wajih Elsallal, et al.; Charateristics of Decade-bandwidth, Balanced Antipodal Vivaldi Antenna (BAVA) Phased Arrays with Time-Delay Beamformer Systems; IEEE International Symposium on Phased Array Systems and Technology.
Michel Arts, et al.; Broadband Differentially Fed Tapered Slot Antenna Array for Radio Astronomy Applications; 2009; 3rd European Conference on Antennas and Propagation; pp. 1-5.
Yongwei Zhang, et al.; Octagonal Ring Antenna for a Compact Dual-Polarized Aperture Array; IEEE Transactions on Antennasand Propagation, vol. 59, No. 10, Oct. 2011; pp. 3927-3932.
Hisao Iwasaki, et al.; A Circularly Polarized Microstrip ANfENNA Using Singly-Fed Proximity CCUPLED Feed; Proceedings of ISAP '92, Sapporo, Japan; pp. 797-800.
Hansen, Robert C. Phased array antennas. vol. 213. John Wiley & Sons, 2009.
Herd, J., and S. Duffy. "Overlapped digital subarray architecture for multiple beam phased array radar." Proceedings of the 5th European Conference on Antennas and Propagation (EUCAP). IEEE, 2011.
L. Ranzani, D. Kuester, K. J. Vanhille, A. Boryssenko, E. Grossman and Z. Popovic, "G-band Micro-fabricated Frequency-steered Arrays with 2deg/GHz Beam Steering," IEEE Transactions on Terahertz Science and Technology, vol. 3, No. 5, Sep. 2013.
Kindt, Rick W, and W. Raymond Pickles. All-Metal Flared-Notch Array Radiator for Ultrawideband Applications. No. NRL/MR/5310-10-9279. Naval Research Lab Washington DC Radar Analysis Branch, 2010.
Doane, Jonathan P., Kubilay Sertel, and John L. Volakis. "A wideband, wide scanning tightly coupled dipole array with integrated balun (TCDA-IB)." IEEE Transactions on Antennas and Propagation 61.9 (2013): 4538-4548.
Moulder, William F., Kubilay Sertel, and John L. Volakis. "Superstrate-enhanced ultrawideband tightly coupled array with resistive FSS." IEEE Transactions on Antennas and Propagation 60.9 (2012): 4166-4172.
Papantonis, Dimitrios K., and John L. Volakis. "Dual-polarization TCDA-IB with substrate loading." 2014 IEEE Antennas and Propagation Society International Symposium (APSURSI). IEEE, 2014.
Herd, J., et al. "Multifunction Phased Array Radar (MPAR) for aircraft and weather surveillance." 2010 IEEE Radar Conference. IEEE, 2010.
J. D. Dyson, "The equiangular spiral antenna," Wright Air Development Center, 1957.
Frank B. Gross; Ultra-wideband antenna arrays—The basics—Part I; Apr. 7, 2011.

* cited by examiner

BROADBAND ANTENNA ARRAY

RELATED APPLICATIONS

This application claims the benefit of priority of U.S. Provisional Application Nos. 62/522,258 filed on Jun. 20, 2017 and 62/614,636 filed on Jan. 8, 2018, the entire contents of which application(s) are incorporated herein by reference.

GOVERNMENT LICENSE RIGHTS

This invention was made with government support under contract number N00014-14-C-0134 awarded by the Office of Naval Research, contract numbers NNX14AI04A and NNX16CG11C awarded by NASA, and contract number FA9453-17-P-0403 awarded by the Air Force Research Laboratory. The government has certain rights in the invention.

FIELD OF THE INVENTION

The present invention relates generally to tightly coupled antenna elements, and more particularly but not exclusively to antenna arrays, including a broadband single or dual polarized, tightly coupled dipole arrays.

BACKGROUND OF THE INVENTION

Wideband antenna arrays with radiating antenna elements that are capable of wide-angle electronic scanning are important components of many current and future microwave and millimeter-wave systems. Electronic scanning removes the need for bulky gimbals or other hardware used to point the antennas. Electronic scanning can be faster than mechanical scanning. It also allows multiple transmission and/or reception antenna beams from a single aperture to be positioned at different locations over a broad field of view, depending on the beamforming circuits or networks behind the antenna, in a way that parabolic reflector antenna systems or other gimbaled antennas cannot. There are several radiating-element designs that can be used to create two-dimensional antenna apertures such as dielectrically loaded/unloaded waveguides, slots, cavity/non-cavity backed patches and single or stacked patches. Wideband radiating antenna elements could enable either continuous coverage of a broad range of frequencies or multiple frequency bands to be covered with a single antenna aperture, depending on the application. This can reduce the number of antenna apertures required in space-constrained systems, which can be limiting based on the real estate available on some platforms that require these antennas (e.g., unmanned aerial systems, or mobile devices). Frequency independent antennas, such as spiral or sinuous antennas, have been known since the 1950's; however, the electrical size of these antennas make them too large to operate in phased arrays without causing grating lobes. Furthermore, interwoven tightly coupled spiral arrays possesses polarization purity issues across their usable frequency range. The length and width of each antenna element unit cell within the array must be close to half of the wavelength of the highest frequency of operation for scan angles approaching +/−60 degrees, although some element designs can be as small as a quarter of a wavelength at the upper end of the frequency range of operation. For less severe scan angles, the antenna element spacing may be larger, perhaps approaching about one wavelength in size. Several previous efforts have been made to create wideband phased arrays antennas, including theoretical papers that describe infinite current sheets, how to impedance match them and how they might be employed. More recently, renewed efforts have been made with improvements in microwave electronics. Prominently among these are the current sheet antenna developed by Munk and commercialized by Harris Corporation based on insights gained through work with frequency selective surfaces. The current invention describes antenna elements capable of wideband operation in electronically scanned phased array antennas that can be scanned to large angles from broadside. These antenna elements eliminate the need for a differential feed, do not require a balun below the ground plane and can be fabricated using advanced manufacturing and assembly methods that will allow them to operate at frequencies beyond those commonly addressed by traditional wideband antenna arrays (at frequencies beyond 20 GHz) made exclusively using circuit board technologies or through assemblies of small components. Another example of a wideband antenna element is the Vivaldi flared-notch antenna, such as one developed by Kindt and Pickles. While bandwidths of 12:1 can be achieved, these antennas suffer from high cross-polarized energy levels in the 45-degree scan plane and typically stand two to three wavelengths tall at the highest frequency of operation. The applications for such antennas include radar, communications, sensors, electronic warfare and antenna systems that perform more than one of these functions.

SUMMARY OF THE INVENTION

In one of its aspects the present invention may provide a broadband dual polarized, tightly coupled dipole antenna elements and arrays, which may be monolithically fabricated via PolyStrata® processing/technology. Examples of PolyStrata® processing/technology are illustrated in U.S. Pat. Nos. 7,948,335, 7,405,638, 7,148,772, 7,012,489, 7,649,432, 7,656,256, 7,755,174, 7,898,356 and/or U.S. Application Pub. Nos. 2010/0109819, 2011/0210807, 2010/0296252, 2011/0273241, 2011/0123783, 2011/0181376, 2011/0181377, each of which is incorporated herein by reference in their entirety (hereinafter the "incorporated Poly Strata® art"). As used herein, the term "PolyStrata" is used in conjunction with the structures made by, or methods detailed in, any of the incorporated PolyStrata® art. Methods and devices of the present invention may provide antenna arrays, including arrays of frequency-scaled broadband elements, that include a feed section having feed posts that are freestanding in a non-solid medium, such as air or a vacuum, and which can be configured and constructed via the PolyStrata® technology to have a shape that permits impedance matching as well as control of capacitive coupling. (As used herein the term "freestanding" is defined to mean structures that are capable of being self-supporting in a non-solid medium, such as air, a vacuum, or liquid, but it is contemplated that such freestanding structures may optionally be embedded in a solid material, though such solid material is not required to support such freestanding structures.) For example, designs of feed sections of the present invention and fabrication via PolyStrata® technology can effect precision control of the geometry of the feed section in order to specify the impedances along the length of the feed section, as well as match the input impedance of the active antenna element to that of the impedance of a feed circuit driving the feed section. In addition, control of spacing between elements of the feed sections helps to tightly control the impedance in the gaps provided by the spacing, and thus capacitive coupling in such locations.

In another of its aspects, the present invention may provide radiator sections in electrical communication with the feed sections to provide antenna elements and arrays, the radiator sections configured for emitting and/or receiving electromagnetic radiation of a selected wavelength. The radiator sections may comprise a generally planar dielectric material patterned with conductive radiator elements and conductive ground elements, such as a printed circuit board. The conductive radiator and ground elements may be configured to distribute capacitance along the length of the radiator element towards the feed connections. In a further of its aspects, the present invention may provide radiator sections that are built as metallic multilayer structures using the PolyStrata® technology, and such radiator sections may be fabricated monolithically with the feed sections or as separate radiator caps which may be subsequently joined to the feed sections.

In yet another of its aspects, the present invention may provide antenna elements and arrays of such elements which are structured to be assembled in egg-crate type fashion. For example, the parts may have generally planar shapes which may be slid together into one another to provide a three-dimensional array. In this regard, slots may be provided in each of the parts, and the parts assembled by sliding respective slots together.

In a further of its aspects, the present invention may provide methods of forming larger arrays of antenna elements from smaller arrays. This can be useful because of manufacturing limitations that necessitate large antenna apertures to be built from arrays of smaller arrays (or subarrays) or because arrays may need to be faceted across non-planar surfaces, such as on an aircraft wing. For these arrays to operate as intended, electrical continuity across these adjacent subarrays must be preserved in a way that preserves antenna performance.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1A:
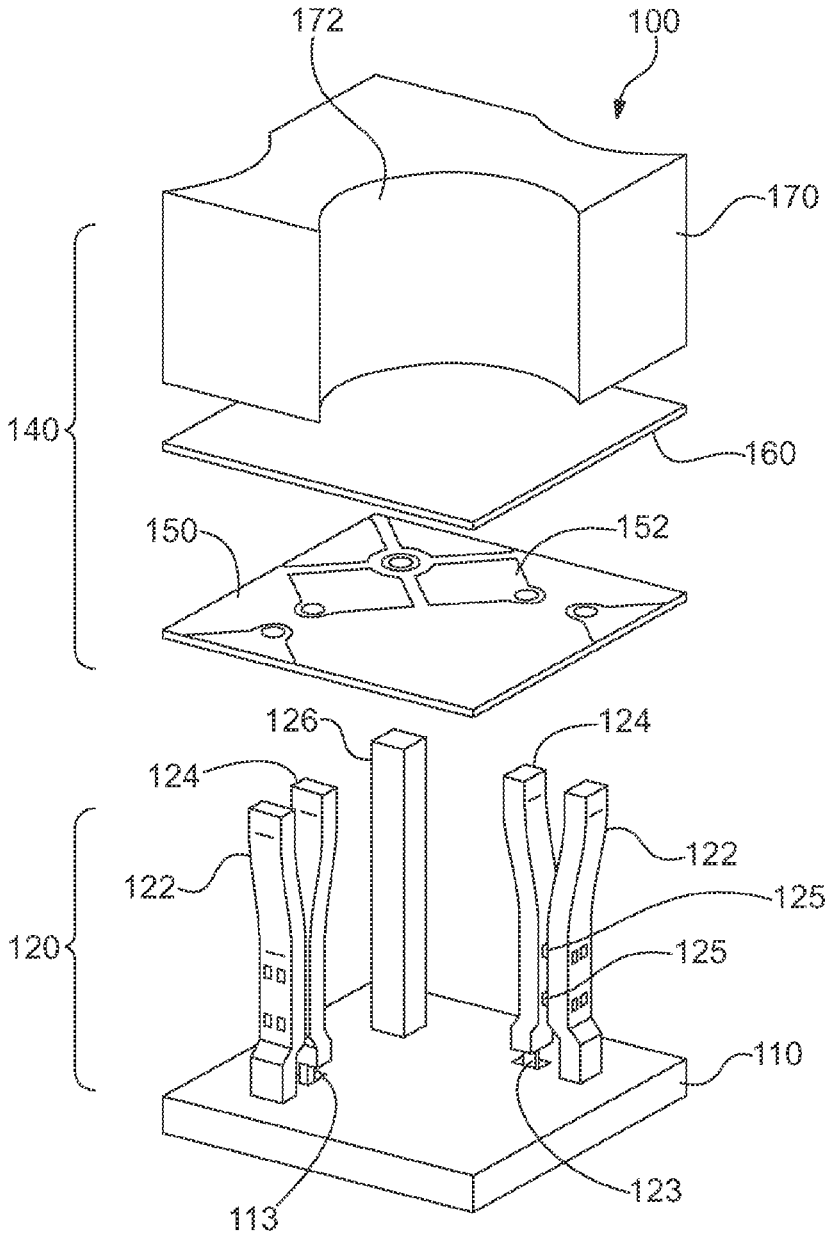
FIGS. 1A, 1B schematically illustrate top and bottom exploded isometric views, respectively, of an exemplary tightly coupled antenna element in accordance with the present invention, showing the ground plane, feed section, and radiator section of the antenna element.
Figure 1B:
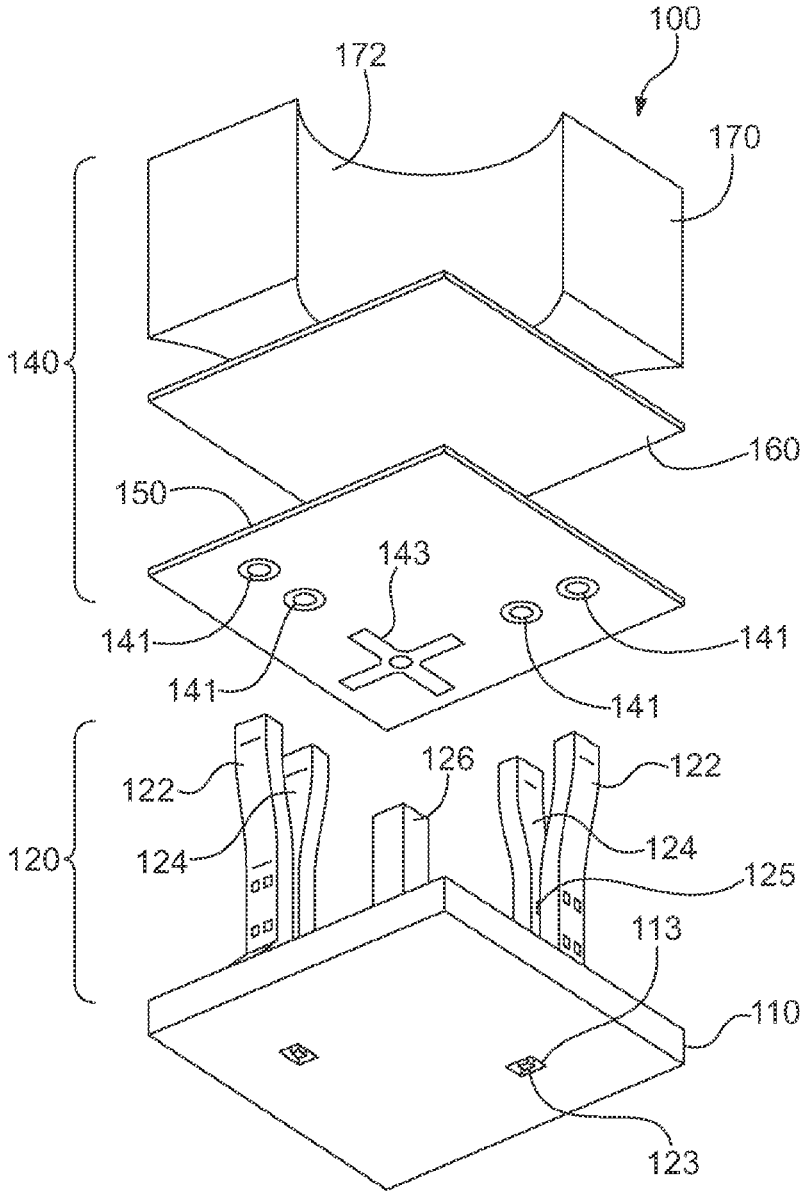
Figure 2A:
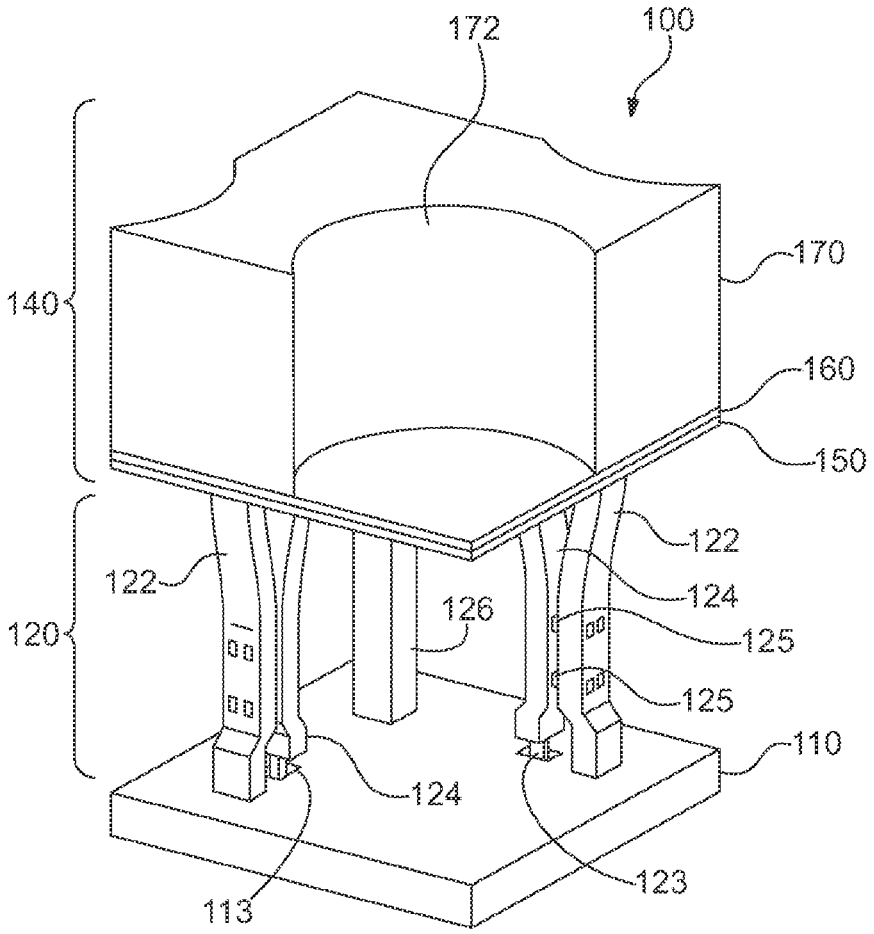
FIGS. 2A, 2B schematically illustrate top and bottom assembled isometric views, respectively, of the antenna element of FIGS. 1A, 1B.
Figure 2B:
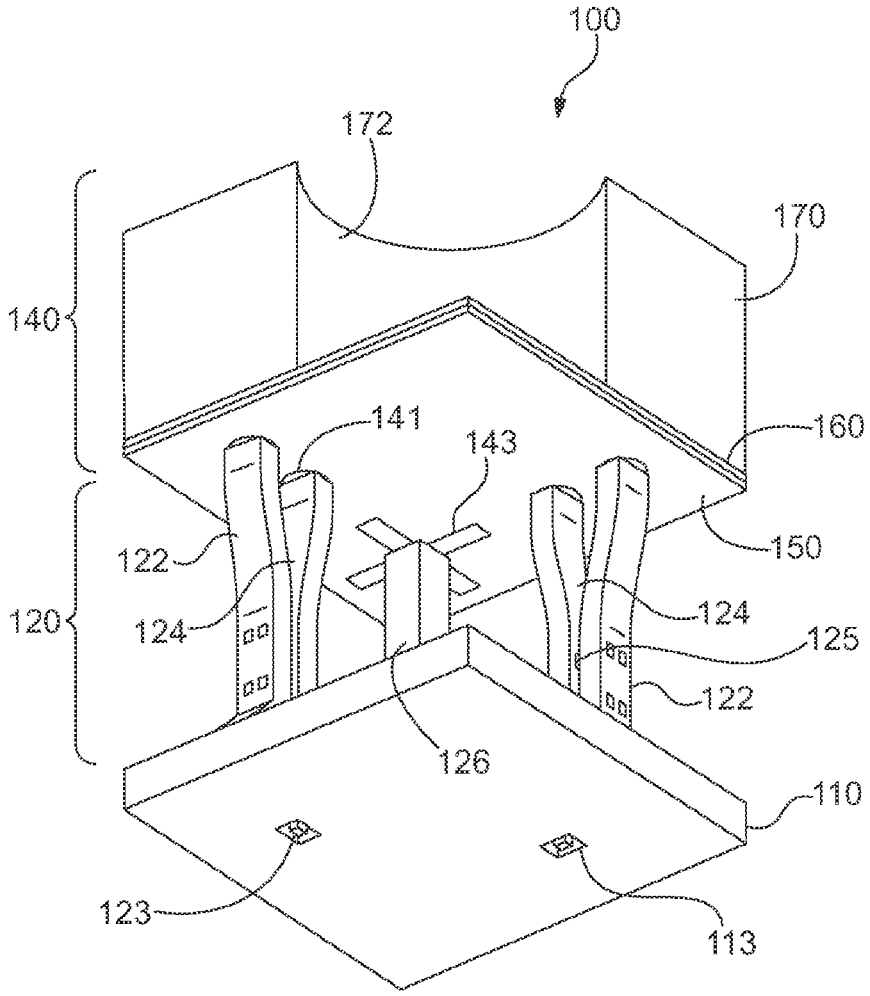

Referring now to the figures, wherein like elements are numbered alike throughout, FIGS. 1A-2B schematically illustrate an exemplary antenna element 100 in accordance with the present invention particularly suited for fabrication by a multilayer build process, such as PolyStrata® technology. In this regard the antenna element 100 may include a feed section 120 which may be freestanding in air (or vacuum) without the need for being embedded in another material such as a dielectric. Disposed on opposing ends of the feed section 120 may be a ground plane 110 and a radiator section 140. (The terms "feed section" and "radiator section" connote the principal functions of the sections, but it is understood, for example, that the antenna element 100 can radiate from all sections to some degree, including the feed section 120.) The exemplary feed section 120 may include pairs of feed posts 122, 124 formed of a conductive material, such as a metal, which may be configured to be fed from a single end. A first post of the pair may be a grounded feed post 122 disposed in electrical communication with the ground plane 110, and a second post of the pair may be a signal feed post 124 having a feed end 123 extending through a respective hole 113 in the ground plane 110 for electrical connection to a feed circuit driving/receiving an electrical signal to/from the antenna element 100. In addition, a centrally-located conductive ground post 126 may be provided in electrical communication with the ground plane 110. The pairs of feed posts 122, 124 may be disposed in a plane perpendicular to the ground plane 110 and containing the ground post 126, and in the case where there are two pairs of feed posts 122, 124 the respective planes of each pair may be perpendicular to one another to provide horizontal and vertical polarizations.

Figure 6:
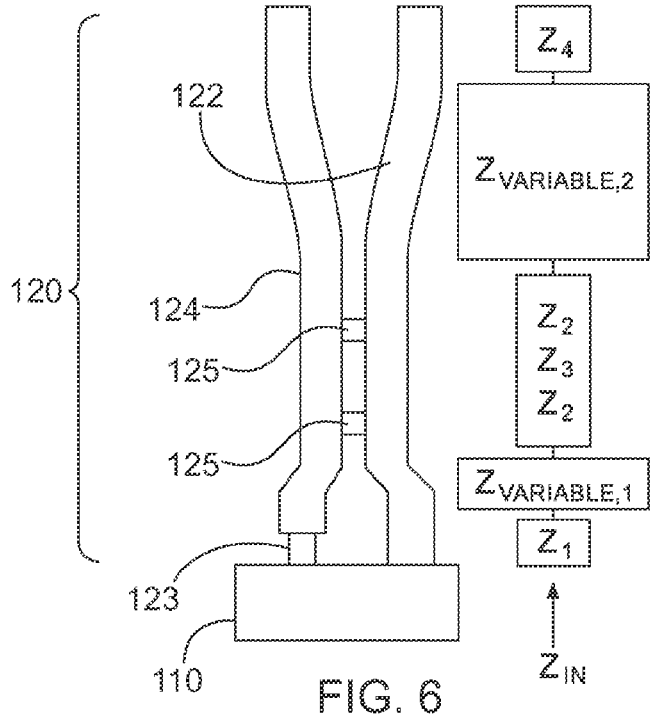
FIG. 6 schematically illustrates a side elevational view of the feed section of the antenna element of FIGS. 1A-2B illustrating how the impedance along feed posts of the feed section can be specified as a function of geometry of the feed posts.

The feed section 120 may be optimized to provide impedance matching at the single ended feed end 123. Specifically, the capacitance/inductance (impedance "Z") may be adjusted (increased/decreased) along the length of the feed section 120 to optimize performance, FIG. 6, such as by modifying the cross-sectional dimension of the feed posts 122, 124, by changing the gaps between them, and optionally including dielectric support bars 125 between the feed posts 122, 124.

Figure 7:
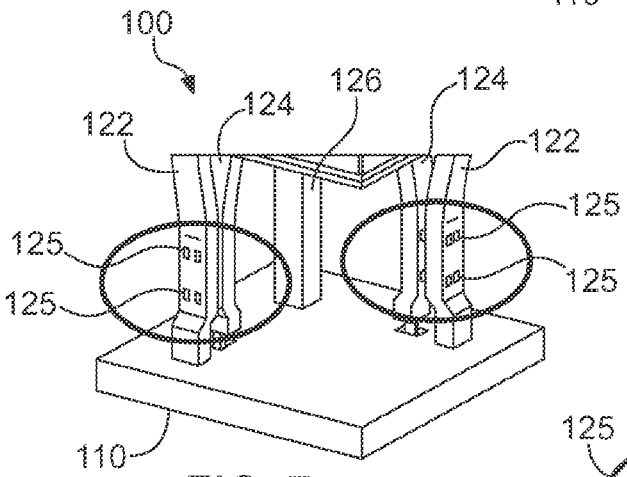
FIGS. 7, 8 schematically illustrate isometric views of the feed posts of FIGS. 1A-2B, both as designed and as implemented in a multilayer build process, respectively.
Figure 8:
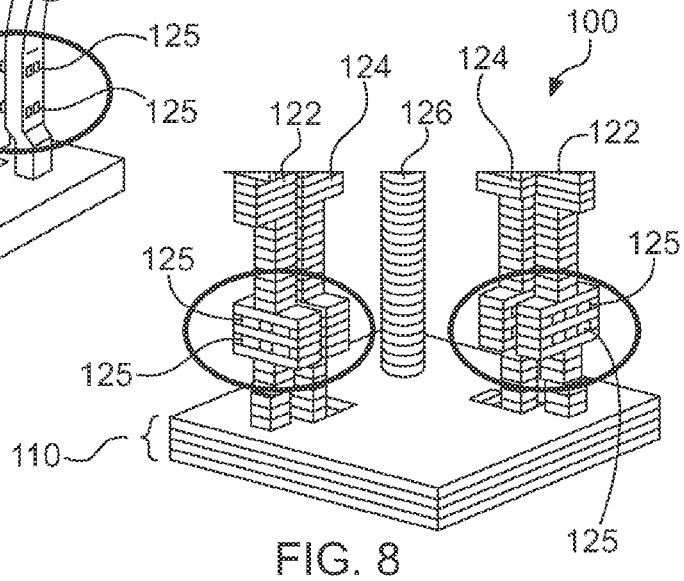

The input impedance, $Z_{in}$, of the feed posts 122, 124, connected to the radiator section 140, may be matched over the frequency range of interest to the characteristic impedance of the feed circuit by creating different impedance sub-sections $Z_1$-$Z_4$ of the feed posts 122, 124. The geometry shown in FIG. 6 may have a general high-low-high impedance progression to match the antenna element 100 to the surrounding medium, which is generally higher than $Z_0$, the characteristic impedance of the coaxial transmission line that connects to the feed section. In addition, curvature of portions of the feed posts 122, 124 may be adjusted in shape to vary the impedance, $Z_{variable,\,1}$, $Z_{variable,\,2}$. $Z_2$ and $Z_3$ may have lower impedance than $Z_4$ based on the gaps between the feed posts 122, 124 in the $Z_2$ regions and the dielectric bars 125. The dielectric bars 125 may also mechanically control the gap between the two feed posts 122, 124 to help tightly control the impedance within these sensitive gaps during normal operating conditions. These sensitivities may be due to manufacturing or environmental concerns. The feed section 120, as well as the ground plane 110, may be fabricated via a multilayer build process, such as the PolyStrata® process, so that one or more of the feed section 120 and ground plane 110 comprise multiple layers of conductive material, such as a metal, stacked up and parallel to the ground plane, FIG. 8. Especially when fabricated via a multilayer build process, the dielectric bars 125 may be embedded in the feed posts 122, 124 and may have a height equal to the height of a single layer, or multiple layers, or a fraction of a layer, FIGS. 7, 8.

Figure 5A:
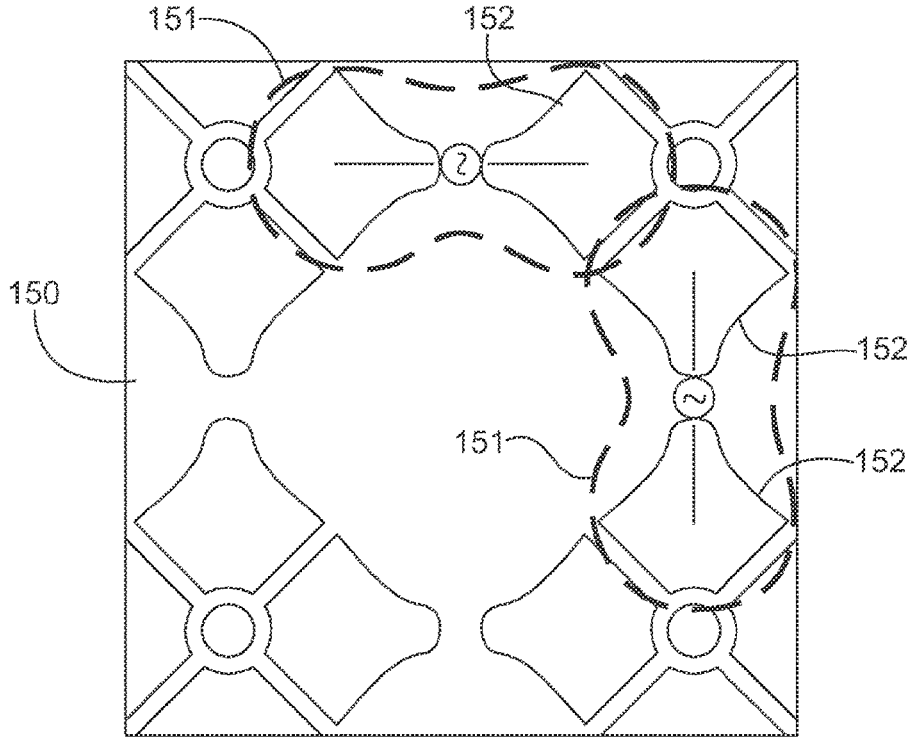
FIG. 5A schematically illustrates a top view of radiating elements of the array of FIG. 3 showing the functional locations of radiating dipoles.
Figure 5B:
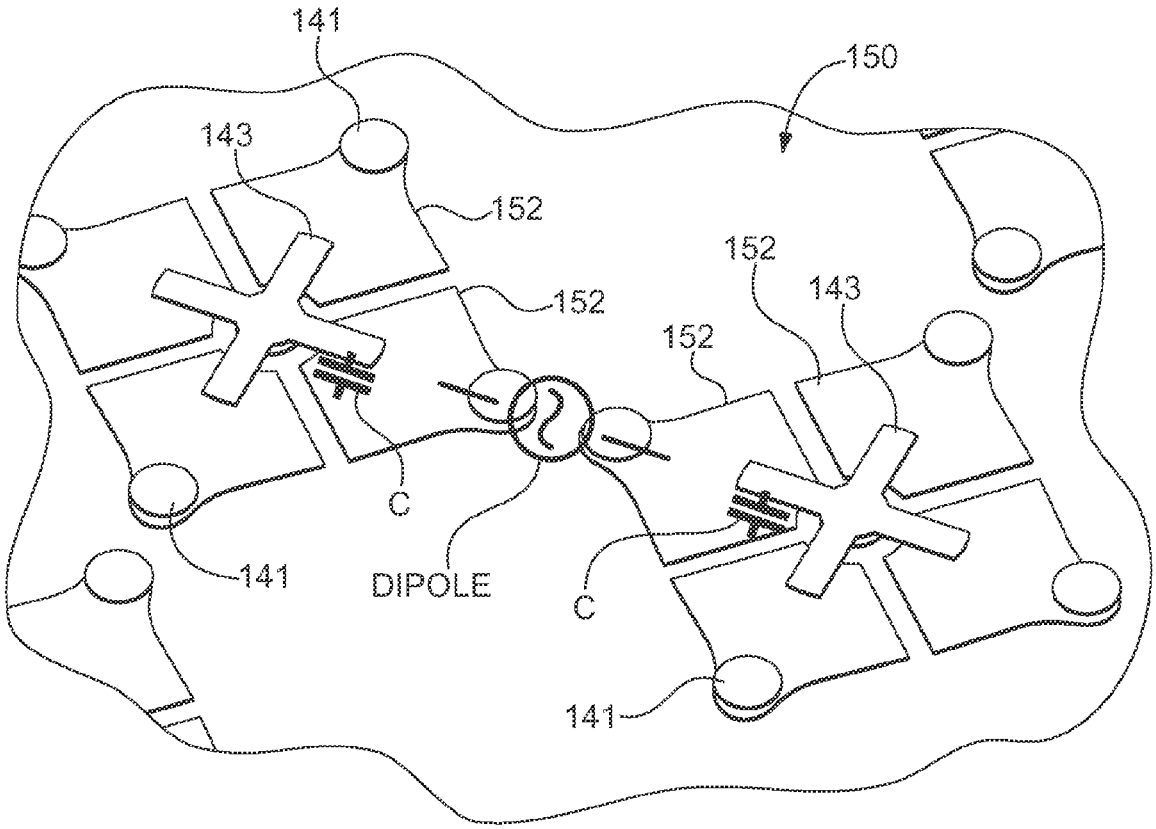
FIG. 5B schematically illustrates an isometric view of radiating elements of the array of FIG. 3 showing capacitive coupling between radiating and ground elements of the antenna element of FIGS. 1A-2B.

Returning to FIGS. 1A-2B, the radiator section 140 may include a generally planar dielectric material, such as a circuit board 150, patterned on either side with conductors to provide conductive radiating elements 152 on an upper surface thereof, and conductive feed connections 141 disposed on the lower surface thereof for electrical communication with the feed posts 122, 124 and electrical communication with the conductive radiator elements 152. The conductive feed connections 141 may be electrically connected to the conductive radiator elements 152 by conductive vias that extend through the circuit board 150. The conductive radiator elements 152 may be configured to function as dipoles 151 with capacitive coupling, ⫫, therebetween, FIG. 5A. In addition, a conductive ground element 143 may be patterned on the lower surface of the circuit board 150 in the form of a plus sign for electrical connection with the ground post 126 to provide capacitive coupling, C, with the radiator elements 152 across the dielectric material of the circuit board, FIG. 5B. Although 143 is drawn as a plus sign, other shapes may be used as the fact that electrical coupling between 152 and the ground post, 126, is facilitated by the geometry of 143. (The non-conductive circuit board 150 is rendered transparent in FIG. 5B to better illustrate the orientation and cooperation between the conductive ground element 143 and radiator elements 152. The electrical symbol for a capacitor, ⫫, is schematically illustrated in FIG. 5B as a label, and does not denote a physical feature having that shape.) The capacitive coupling may have a capacitance in the range of 20 fF to 50 fF, for example. Since the conductive ground element 143 may have a plus shape, capacitive coupling between the conductive ground element 143 and radiator elements 152 may be distributed along the length of each arm of the conductive ground element 143 to create distributed capacitance along the radiator elements 152.

Figure 3:
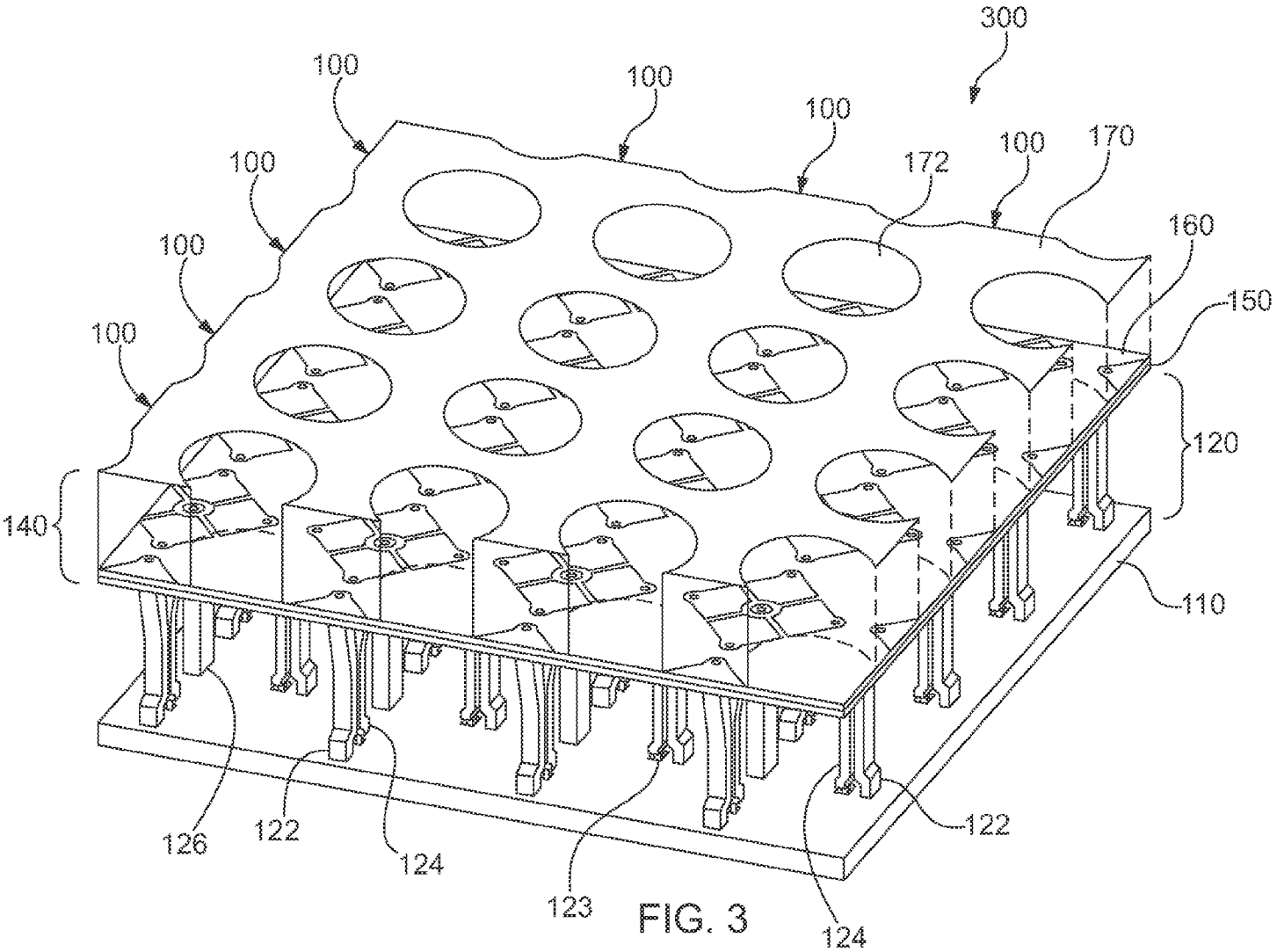
FIG. 3 schematically illustrates an isometric view of an exemplary antenna array in accordance with the present invention comprising antenna elements of FIG. 2A showing an apertured dielectric superstrate disposed on top.
Figure 4:
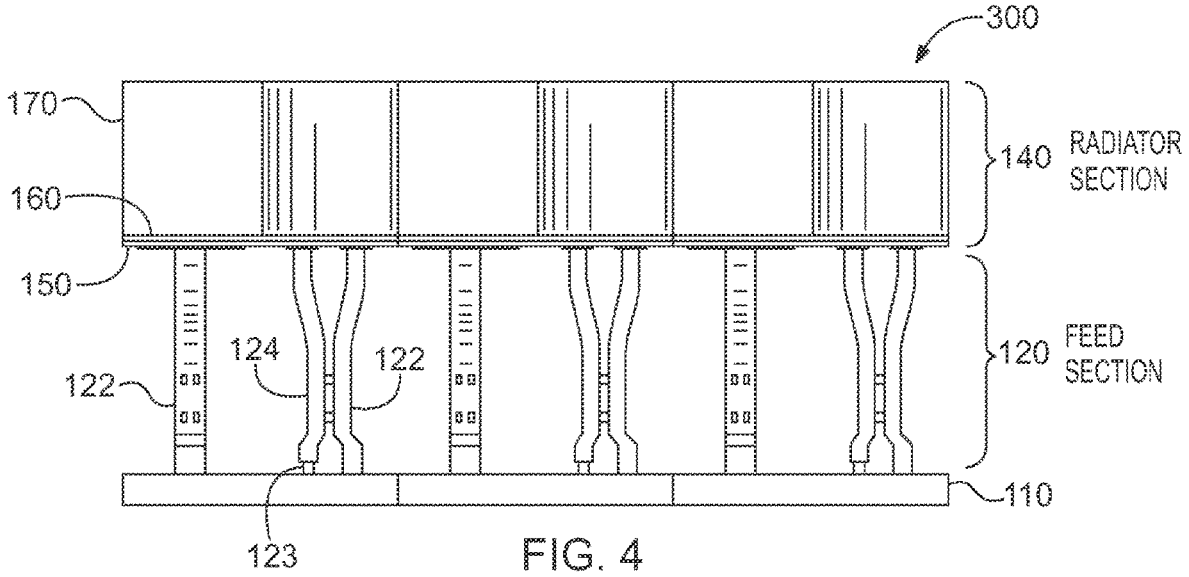
FIG. 4 schematically illustrates a side elevational view of the array of FIG. 3.

The radiator section 140 may also include a dielectric superstrate 170, which may have an aperture 172 disposed therein, which may be attached to the radiator board 150 via a bond film 160. The aperture 172 in the superstrate 170 may assist in decreasing the effective dielectric constant of 170 and may be positioned at a location over the radiator board 150 at which the conductive radiator elements 152 are not disposed. The usefulness of the apertures 172 may be better appreciated when the antenna elements 100 are utilized to form an array 300, such as a tightly coupled dipole array, as illustrated in FIGS. 3, 4, in which the antenna elements 100 are organized in a rectilinear fashion. The apertures 172 may lower the effective dielectric constant of the superstrate 170 without disrupting the capacitance in the coupling region.

Figure 9:
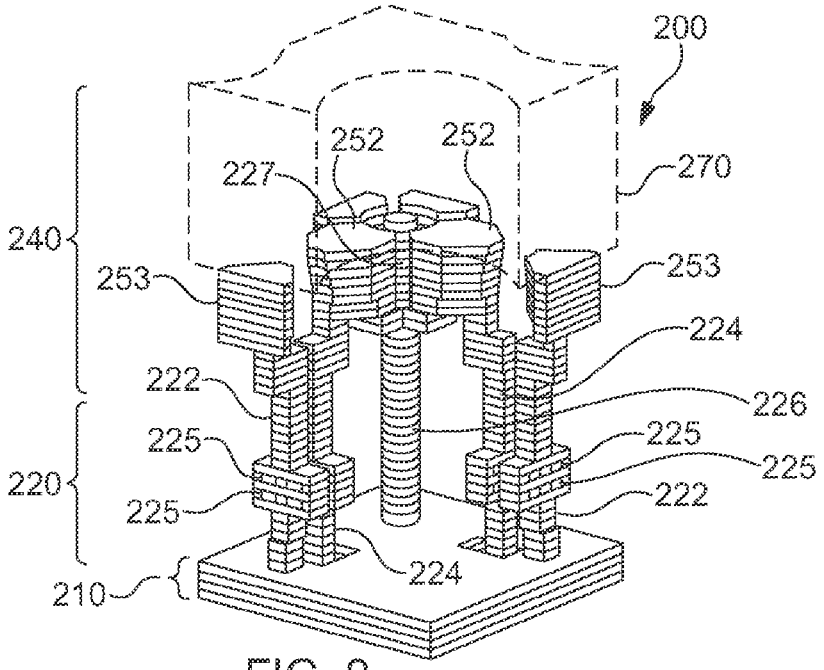
FIGS. 9, 10 schematically illustrate isometric and side elevational views, respectively, of an alternative exemplary configuration of an antenna element in accordance with the present invention wherein the radiating elements may be monolithically formed with the feed section by a multilayer build process.
Figure 10:
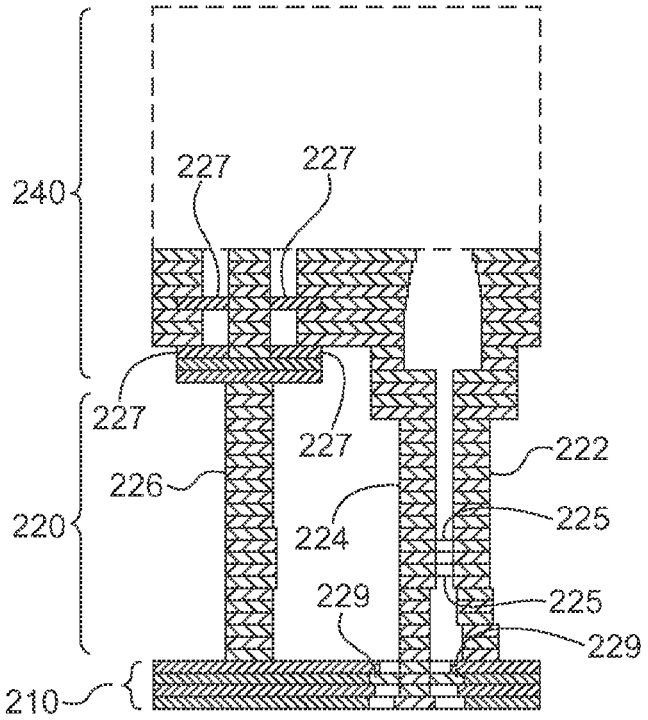

In a further aspect of the present invention, the radiator section 240, like the feed section 220 and ground plane 210, may be built by a multilayer process, such as the Poly Strata® process, and may be formed monolithically together with the feed section 220, FIGS. 9, 10. In this regard the antenna element 200, may include a ground plane 210, feed posts 222, 224, a ground post 226, dielectric support bars 225, and an apertured dielectric superstrate 270, similar to similarly named features disclosed and discussed in connection with the antenna element 100 of FIGS. 1A-2B, all of which may be multilayer structures. The conductive radiating elements 252, 253 may also comprise multilayer structures and in this exemplary configuration may include dielectric radiator support bars 227 that extend between the ground post 226 and the conductive radiator elements 252, FIG. 10. Fabricating the radiator section 240 in a multilayer process allows the designer multiple degrees of freedom to thicken and shape the radiator elements 252, 253, ground post 226 and associated ground elements, and coupling gaps maintained by support bars 227. For example, having more independent control of the radiator element to radiator element 252, 253 coupling from the radiator element 252, 253 to ground post 226 and associated ground elements, allows the designer more flexibility in customizing the antenna element performance. In addition, dielectric support bars 229 may be provided to help support the end of the feed post 224 disposed within the ground plane 210, FIG. 10.

Figure 11:
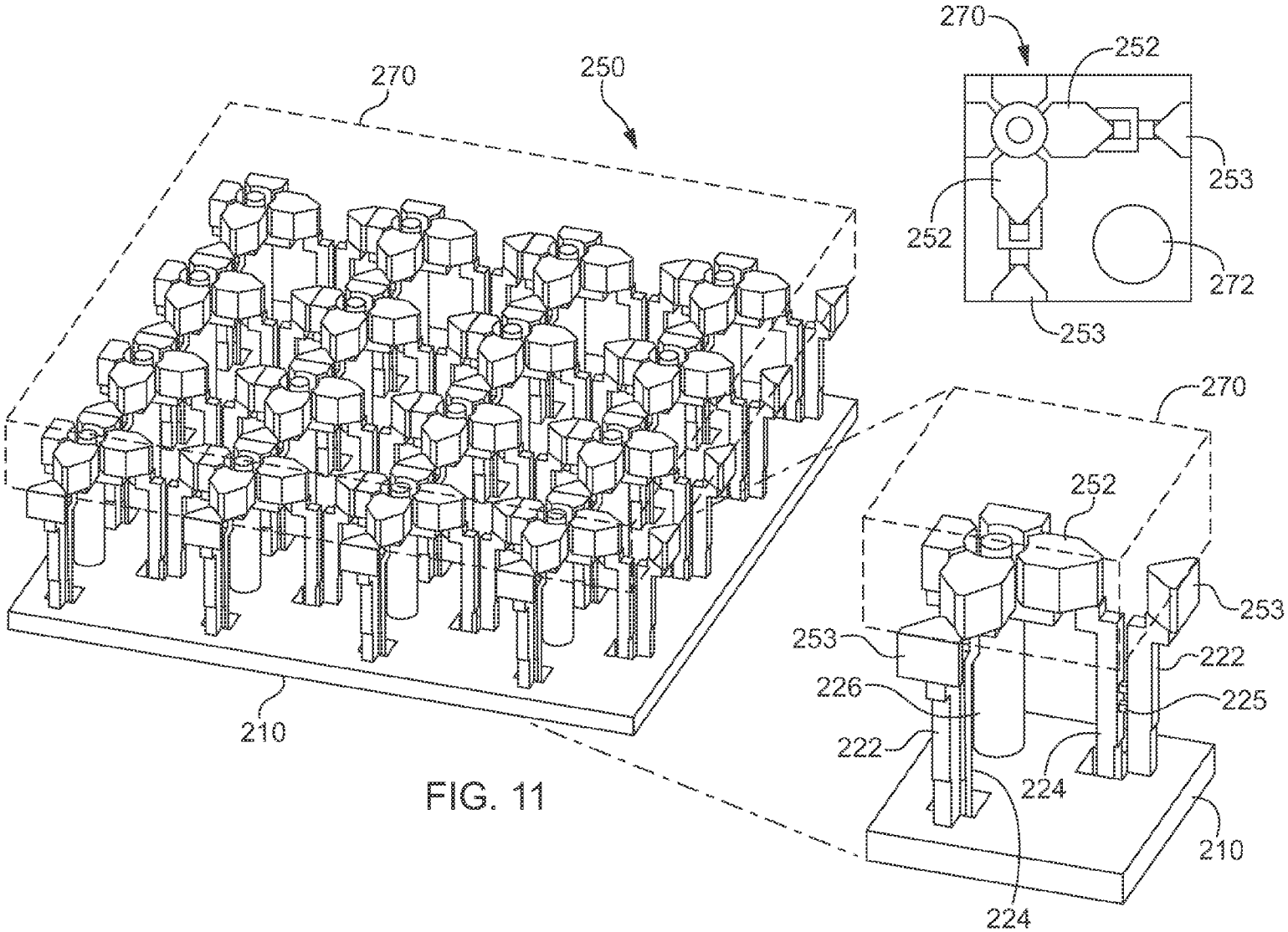
FIG. 11 schematically illustrates an isometric view of an exemplary antenna array in accordance with the present invention comprising antenna elements of FIGS. 9, 10.
Figure 12A:
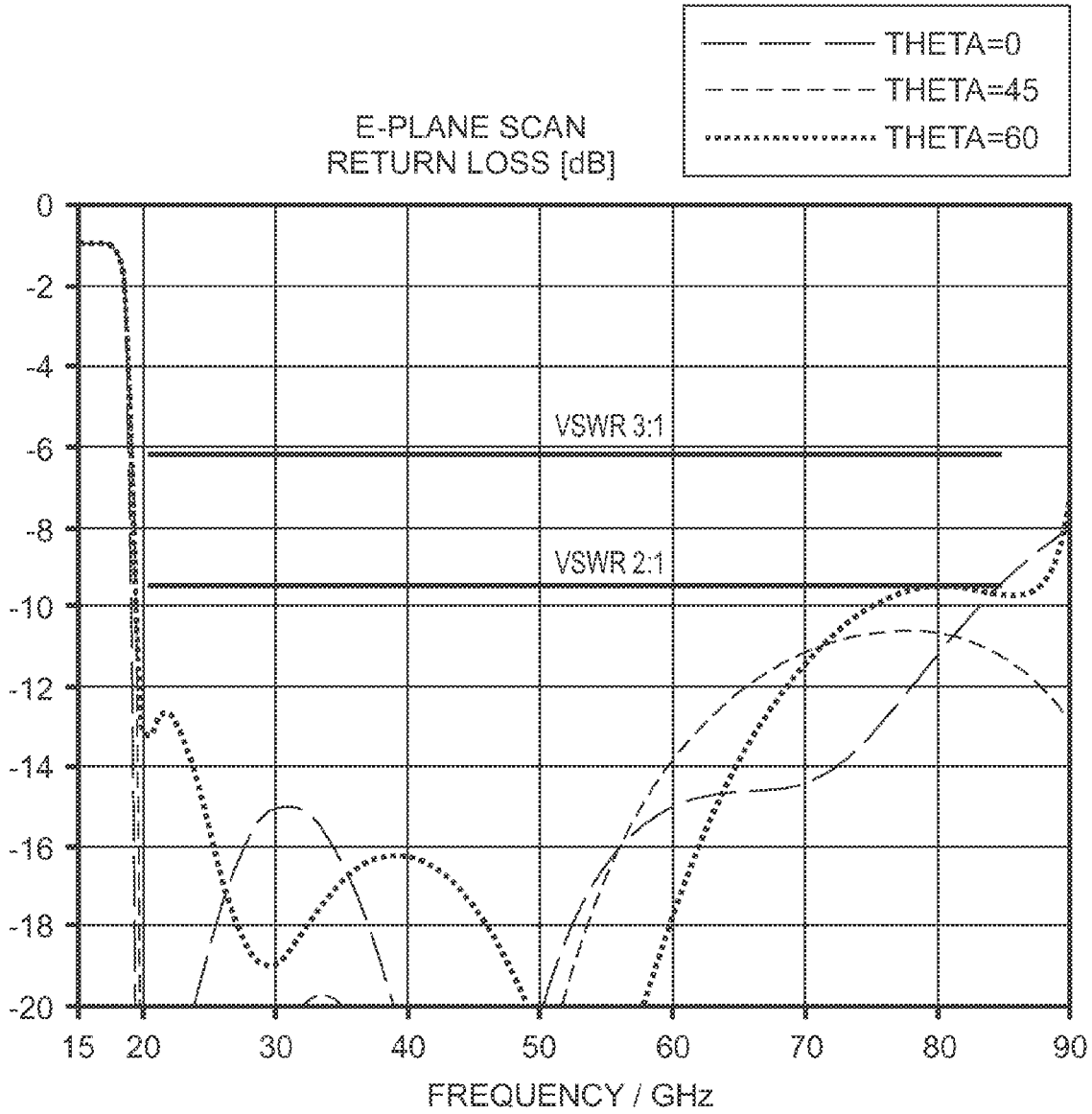
FIGS. 12A-12C illustrate calculated return loss and cross polarization plots for the E-plane and H-plane and radiative x-pol in the D-plane, respectively, of the array of FIG. 11 for active element scan theta values of 0, 45 and 60 degrees.
Figure 12B:
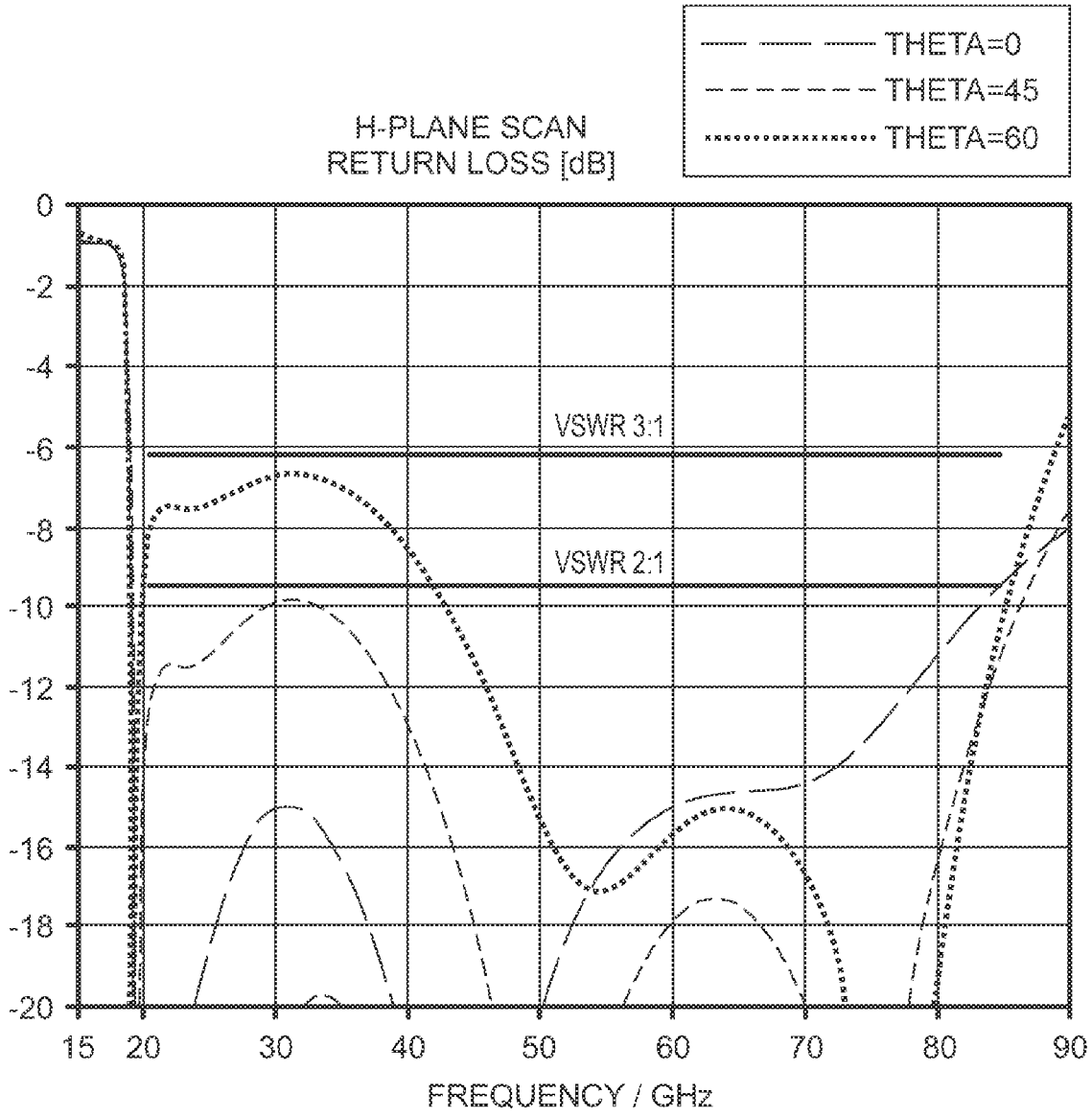
Figure 12C:
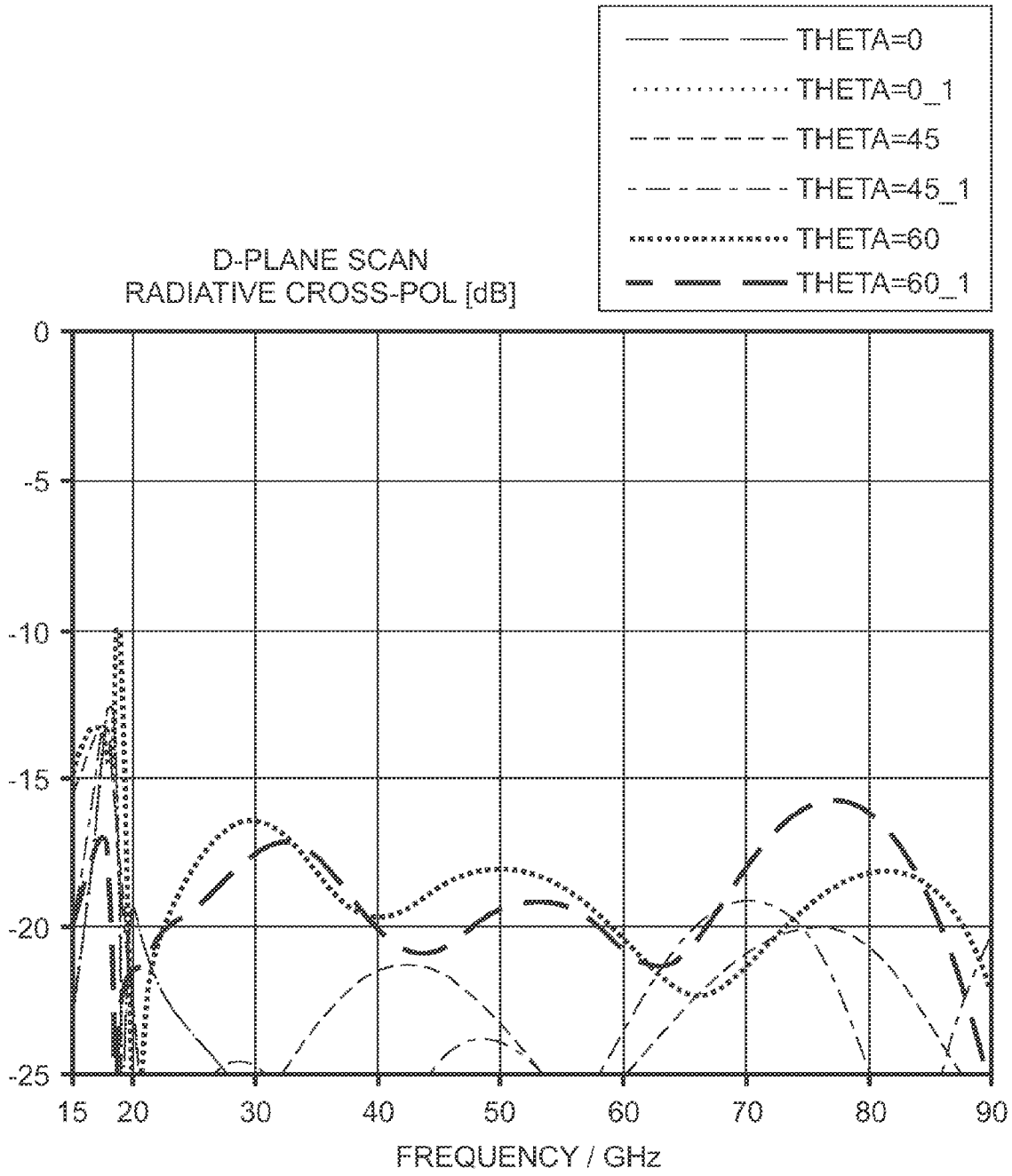

A dual polarized, tightly coupled dipole 4×4 array 250 of antenna elements 200 may be provided with apertures 272 disposed within the superstrate 270, FIG. 11. Multiple such arrays 250 may also be tiled together. The calculated expected performance of the tightly coupled dipole array 250 of FIG. 11 in the frequency range of 19-86 GHz is provided in FIGS. 12A-12C and shows a VSWR of 2:1 or better for 20-83 GHz for scan angles up to 45 degrees and better than VSWR of 3:1 for scan angles up to 60 degrees. In addition, the radiative cross polarization isolation is better than 20 dB for most of the 4.5:1 bandwidth at 45-degree scan and better than 15 dB for a 60-degree scan in the diagonal plane, FIG. 12C. This may all be accomplished for an element that is less than 0.6-lambda tall at 83 GHz (2.16 mm).

Figure 13A:
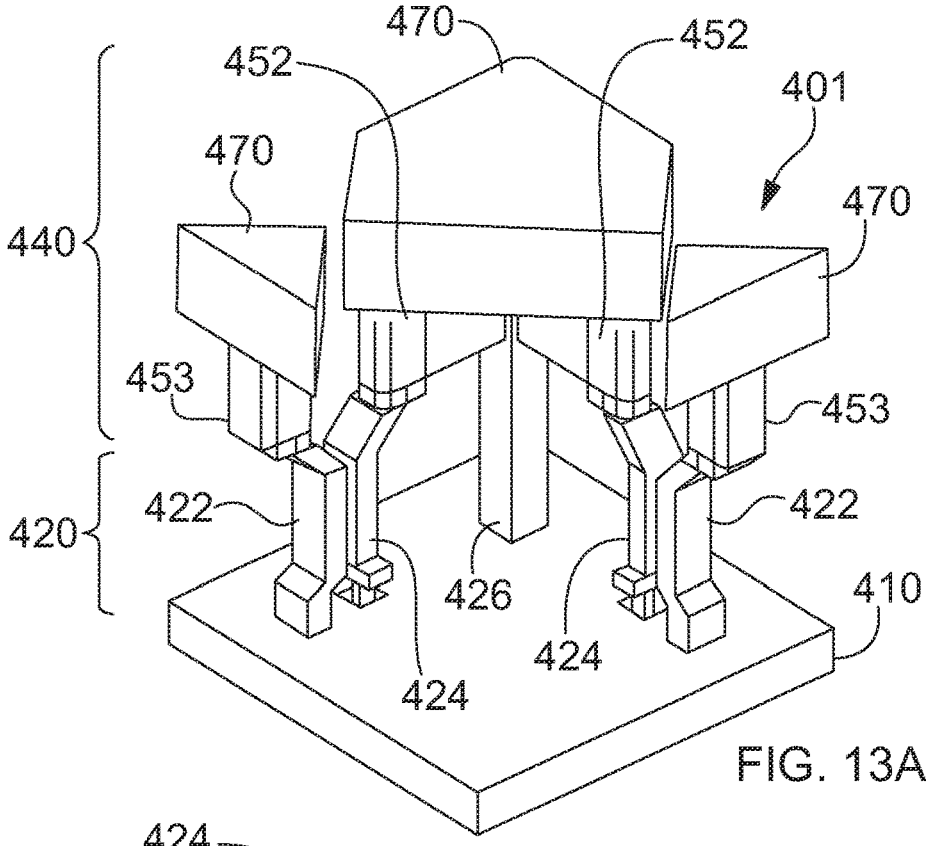
FIG. 13A schematically illustrates an isometric view of a further exemplary configuration of a unit cell of an antenna element in accordance with the present invention wherein the radiating elements are formed by a multilayer build process.
Figure 13B:
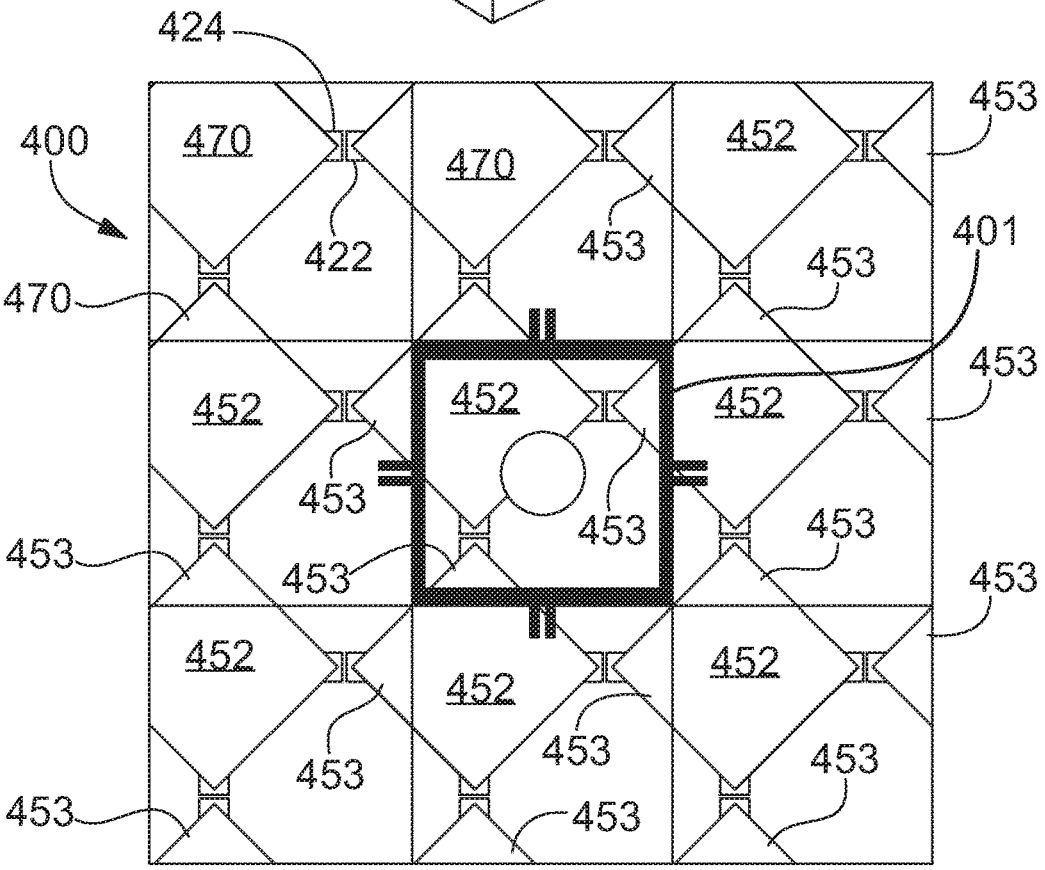
FIG. 13B schematically illustrates a top view of a subarray including nine unit cells of FIG. 13A.

In yet another of its aspects, the present invention may provide a subarray 400 built by a multilayer process (e.g., PolyStrata® technology) from a conductive material, such as a metal, in which one or more of the ground plane 410, feed section 420 (including feed posts 422, 424) and radiator section 440 are built by a multilayer process, and in which the radiator section 440 comprising radiating elements 452, 453. A non-continuous dielectric matching layer 470 may be fabricated separately from the feed section 420 and installed on the radiating elements 452, 453, FIGS. 13A, 13B. The subarray 400 may include, for example, nine unit cells 401, with the center unit cell shown in FIG. 13B outlined in bold. When viewed as a large enough portion of the full subarray to show a complete radiator cap, the radiator section 440 may be provided as radiator section cap 540 having a generally square shape when viewed from above. The radiator section cap 540 may be mounted and electrically connected to feed posts 522, 524 and ground post 526 of the feed section 520 disposed on the ground plane 510, FIG. 13C. Consequently, when the radiator element 452 of the subarray 400 is viewed in the context of an overall antenna element 500, it can be seen that radiator elements 452, 453 are fragmentary views of a radiator section cap 540 that is square in shape, FIGS. 13B, 13C. Much like the distributive coupling illustrated in FIG. 5B, similar conductive and non-conductive structures can be implemented in the radiator section 440, 540. The radiator section caps 540 may be used to join a plurality of subarrays 400 together to provide an antenna array 600, FIGS. 13D-13G. For example, twelve radiator section caps 540 may be provided around the periphery of a subarray 400 to join the subarray 400 to adjacent subarrays 400 with each cap 540 around the periphery connected to feed posts 522, 524 on at least two different subarrays 400, FIGS. 13D-13G. A dielectric superstrate 570 may also be provided.

The antenna elements 100, 200, 500 and arrays 250, 300 that may be formed therefrom do not require a balun or impedance transformer. The antenna elements 100, 200, 500 may be fed by a single 50-Ohm port for the V-polarization and H-polarization. The antenna elements 100, 200, 500 and arrays 250, 300 may be fabricated using the PolyStrata® process with +/−2 μm tolerances in all three axes, which is far better than what is required at 83 GHz, and better than other fabrication methods such as 3-d printing (20-micron tolerance for high-end systems) and machining (12-micron tolerance).

Figure 14:
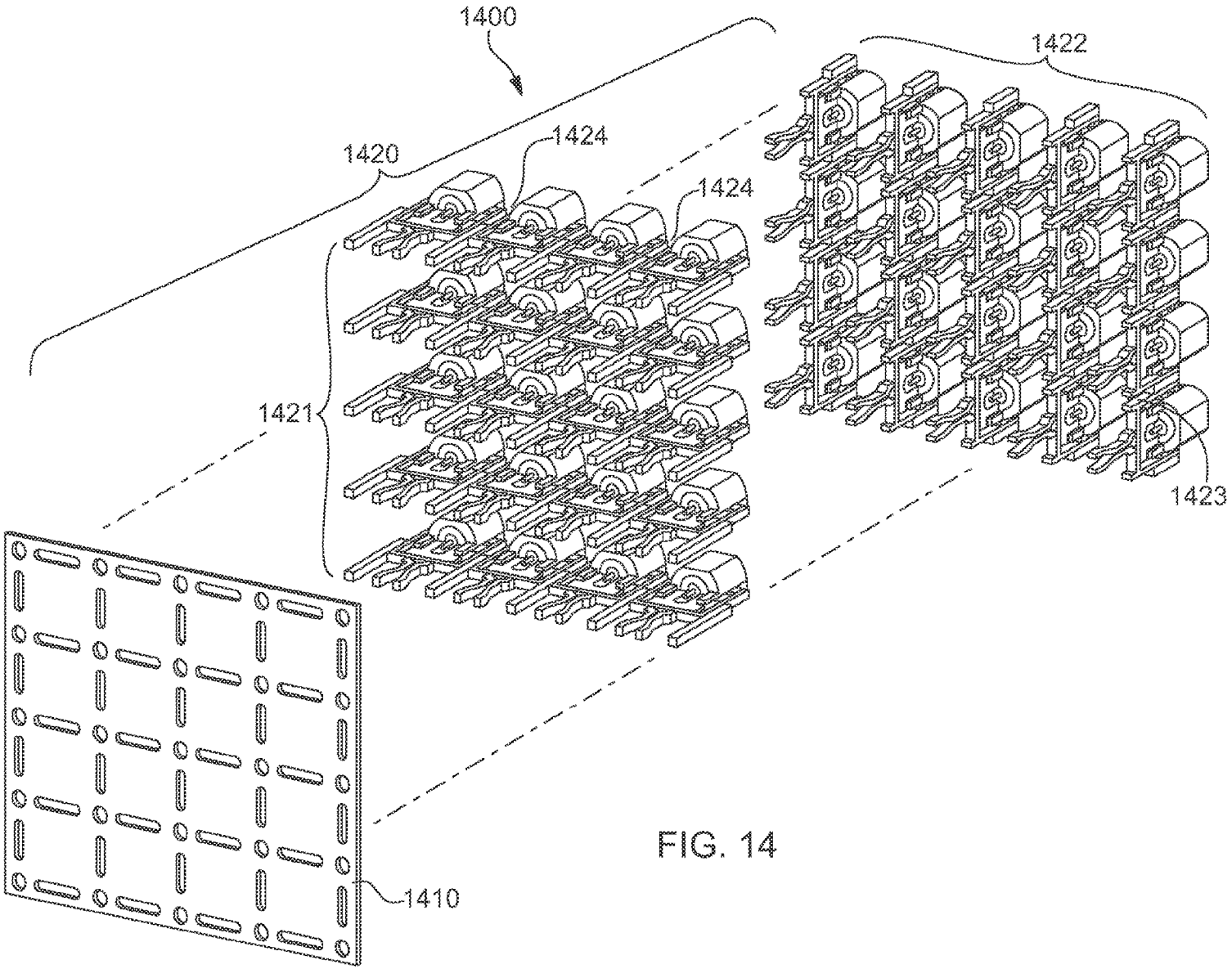
FIG. 14 schematically illustrates an isometric exploded view of a particular configuration for manufacturing the array of FIG. 3 in which groupings of feed posts can slide together in egg-crate fashion to form the feed section and in which the feed posts may be inserted through openings in the ground plane to provide the combined ground plane feed section structure.

In yet another of its aspects, the present invention may provide particular structures for realizing an egg-crate approach 1400 for assembling antenna elements in accordance with the present invention, FIG. 14, which may also be particularly suited for fabrication by a multilayer build process, such as PolyStrata® technology. For example, the aforementioned feed structures, such as feed structure 120, may be provided as first linear arrays 1421 containing one polarization of feed posts and second linear arrays 1422 containing a second orthogonal polarization of feed posts. Each of the linear arrays 1421, 1422 may include respective slots 1424, 1423 so that the arrays 1421, 1422 may be slid into one another in egg-crate type fashion to provide a feed structure 1420, FIG. 15. To accommodate the arrays 1421, 1422, a ground plane 1410 may be provided with complementary openings disposed therein to receive feed posts of the arrays 1421, 1422, which may be slid therethrough to provide the final assembled ground plane 1410 and feed structure 1420, FIG. 16. For example, ground plane 1410 and feed structure 1420 may be used as a ground plane 110 and feed structure 120 of the array 300 of FIG. 3.

Figure 13C:
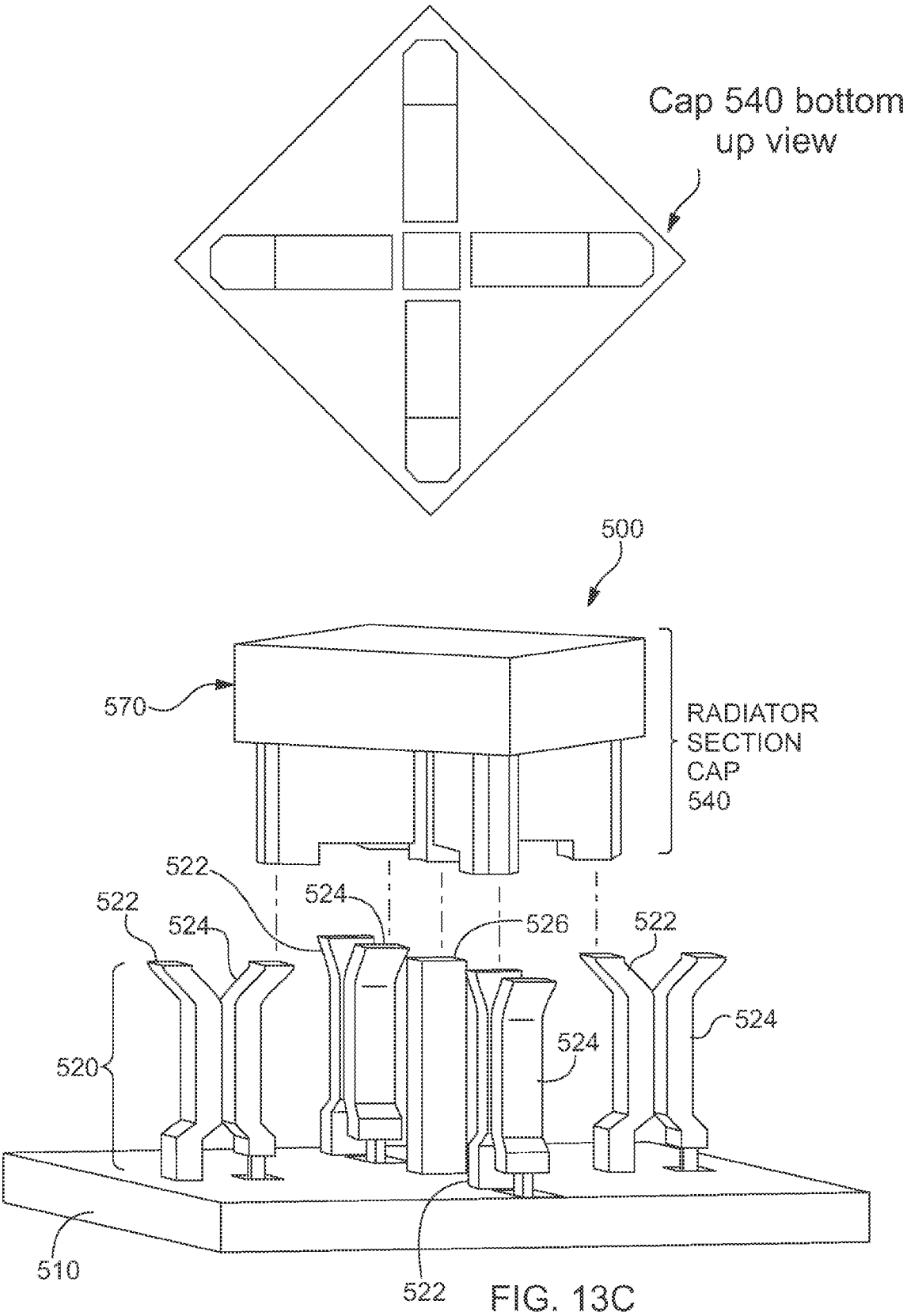
FIG. 13C schematically illustrates, in an exploded isometric view, an antenna element including the unit cell of FIG. 13A, showing that the radiator section may be provided as a separate cap which plugs onto the feed section.
Figure 13D:
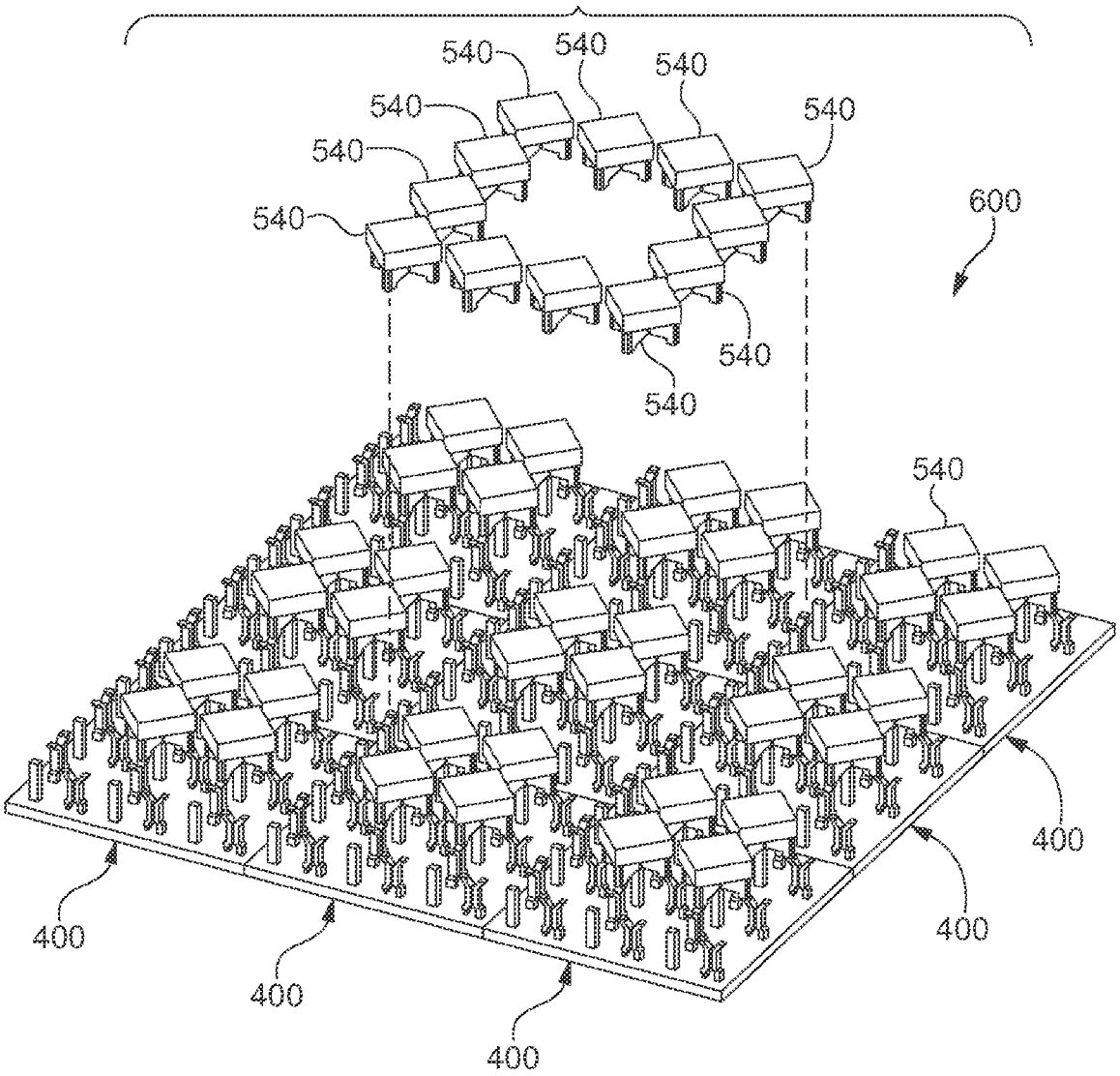
FIGS. 13D, 13E schematically illustrate exploded and assembled isometric views, respectively, of nine of the subarrays of FIG. 13B tiled together using the separate radiator caps of FIG. 13C.
Figure 13E:
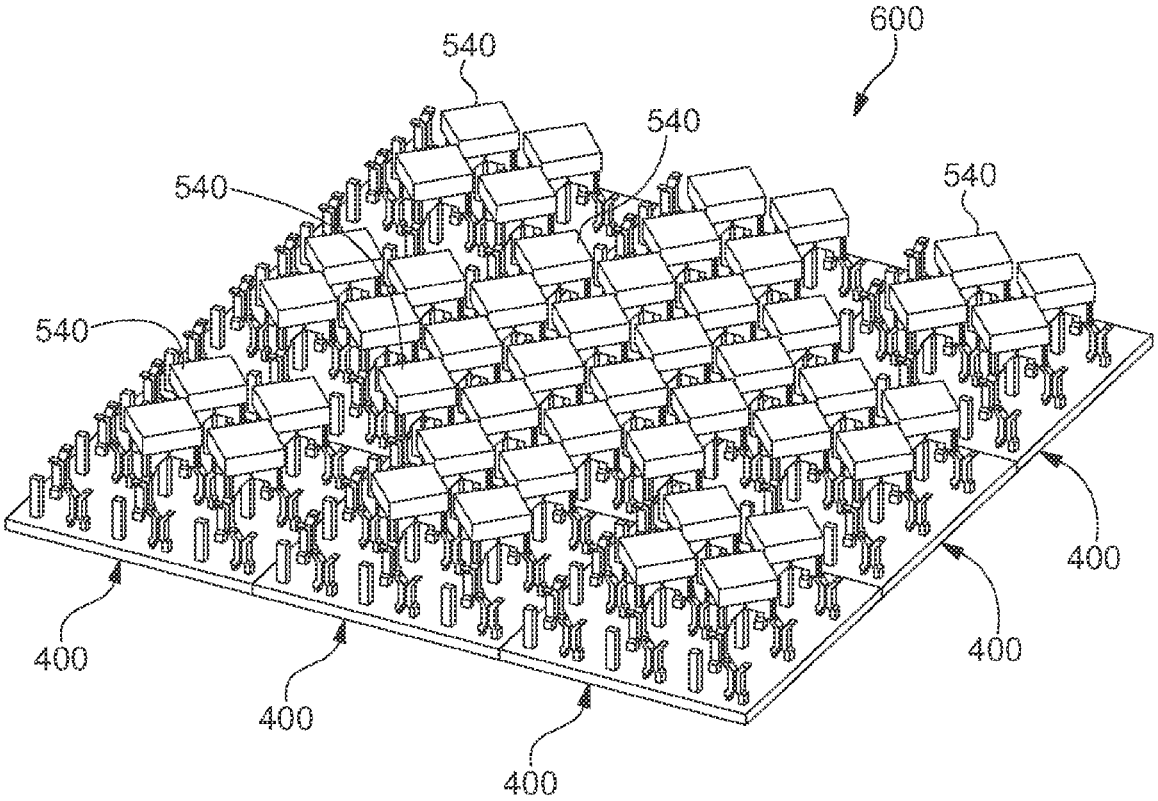
Figure 13F:
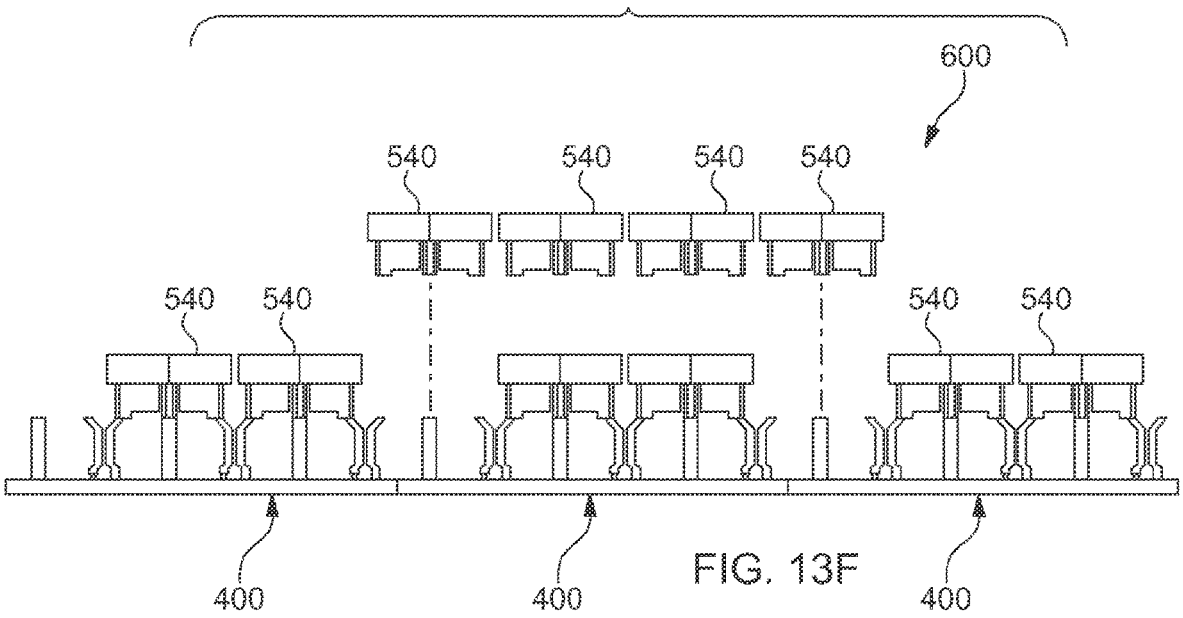
FIGS. 13F, 13G schematically illustrate in exploded and assembled side elevational views, respectively, of the subarrays of FIGS. 13D, 13E.
Figure 13G:
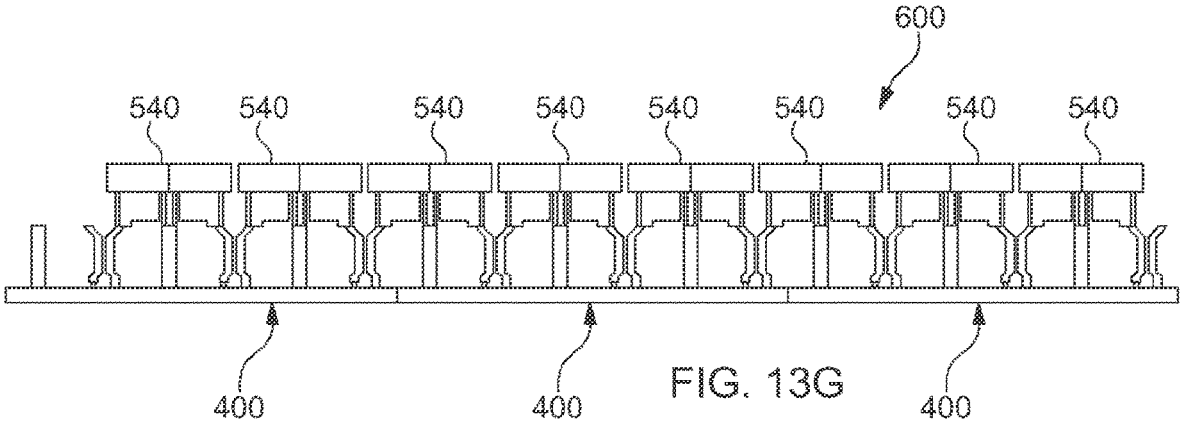

In addition to using the egg-crate type approach for the feed structures and ground planes of FIGS. 1A and 13C, for example, the approach may also be used for ground planes, feed sections, and radiator sections. For instance, with reference to FIGS. 17A-17D, an antenna element 700 having a horizontal polarization card 701 and vertical polarization card 702 may be provided, each of which cards includes a respective portion thereof that corresponds to a monolithically fabricated feed and radiator section 720, 730 and card ground sections 721, 731. (Again, the term "feed and radiator section" is not intended to indicate that only the radiator section radiates, as the feed sections can radiate as well. Rather, the term "feed and radiator section" is used as a matter of convenience to describe a portion of the cards 701, 702.) The card ground sections 721, 731 may include channels 761, 763 through which transmission lines 762, 764 are routed to communicate with circuitry disposed below the feed and radiator sections 720, 730, to provide a single ended feed to the cards 701, 702.

Figure 17A:
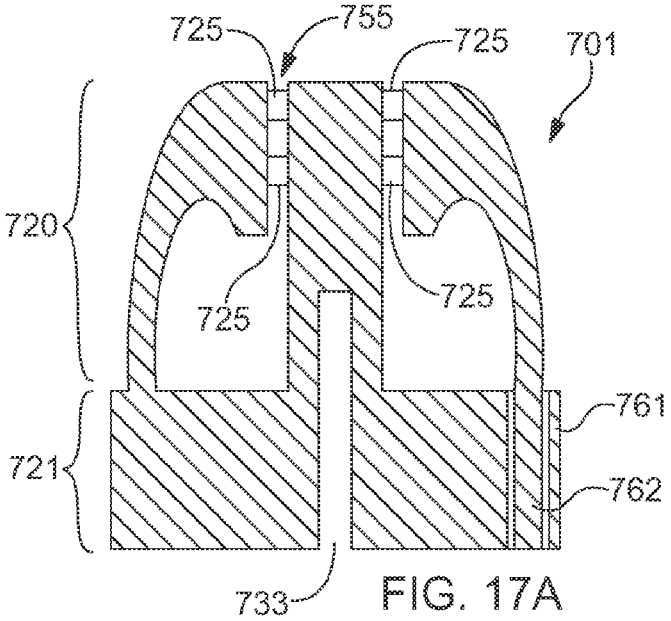
FIG. 17A schematically illustrates a cross-sectional view of a first exemplary component of an antenna element in accordance with the present invention having both feed and radiator sections provided in a generally planar structure having a mating slot.
Figure 17B:
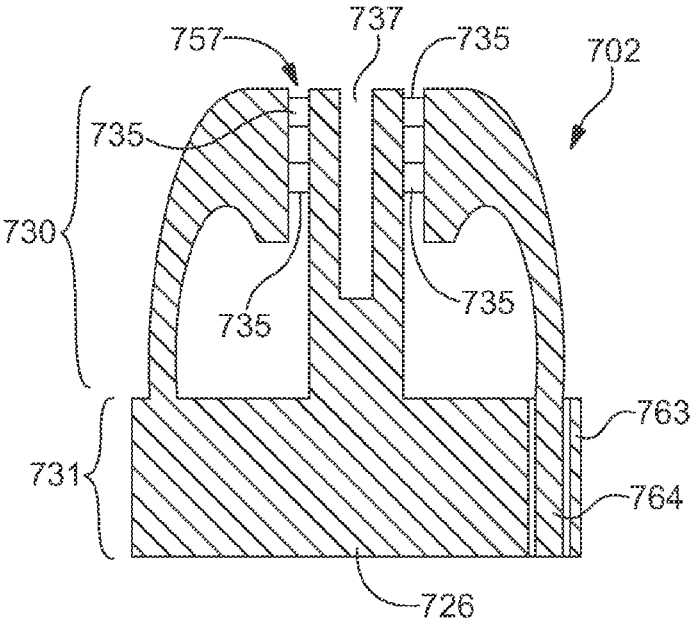
FIG. 17B schematically illustrates a cross-sectional view of a second exemplary component of an antenna element in accordance with the present invention having both feed and radiator sections provided in a generally planar structure having a mating slot complementary to the slot of FIG. 17A.
Figure 17C:
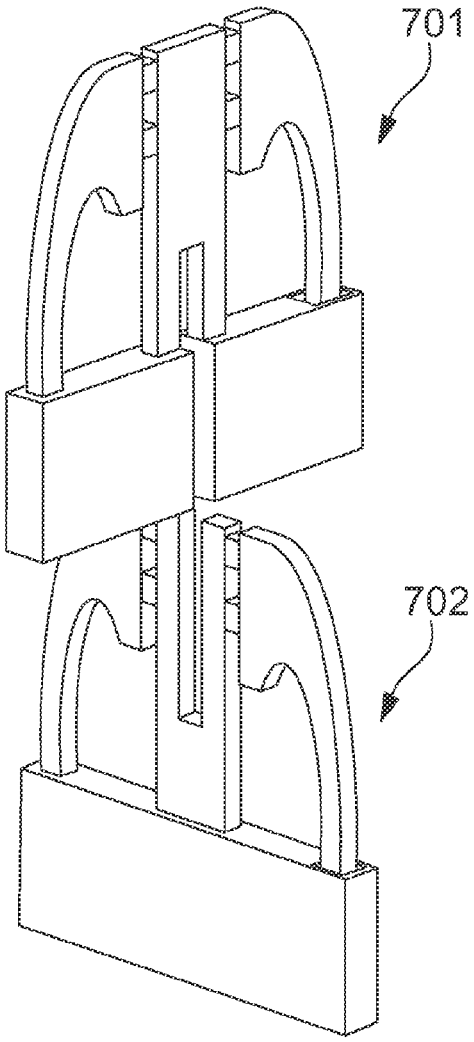
FIG. 17C schematically illustrates the antenna elements of FIGS. 17A, 17B oriented for insertion into one another.
Figure 17D:
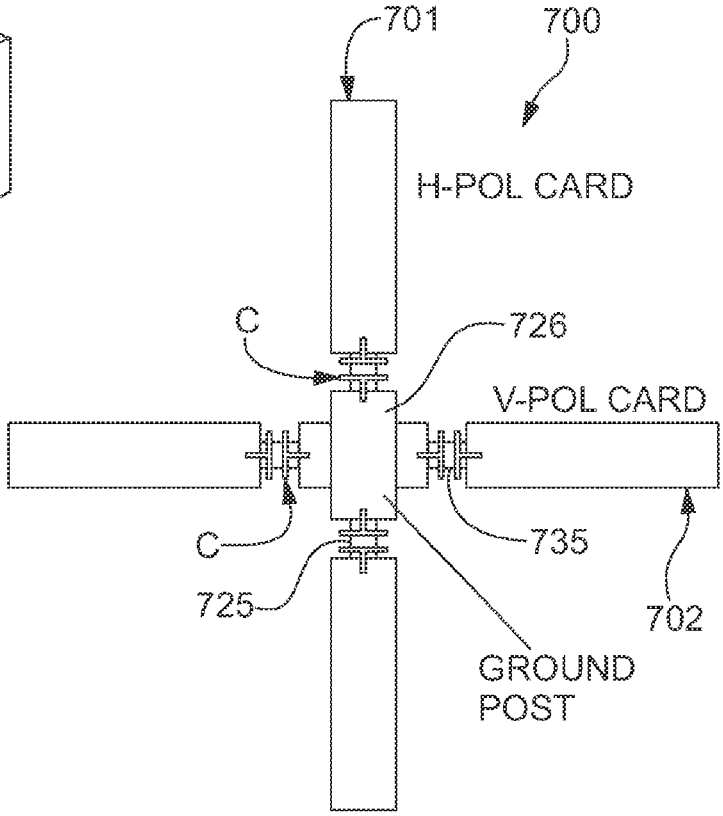
FIG. 17D schematically illustrates a top view of the antenna elements of FIG. 17C after insertion into one another.
Figure 18:
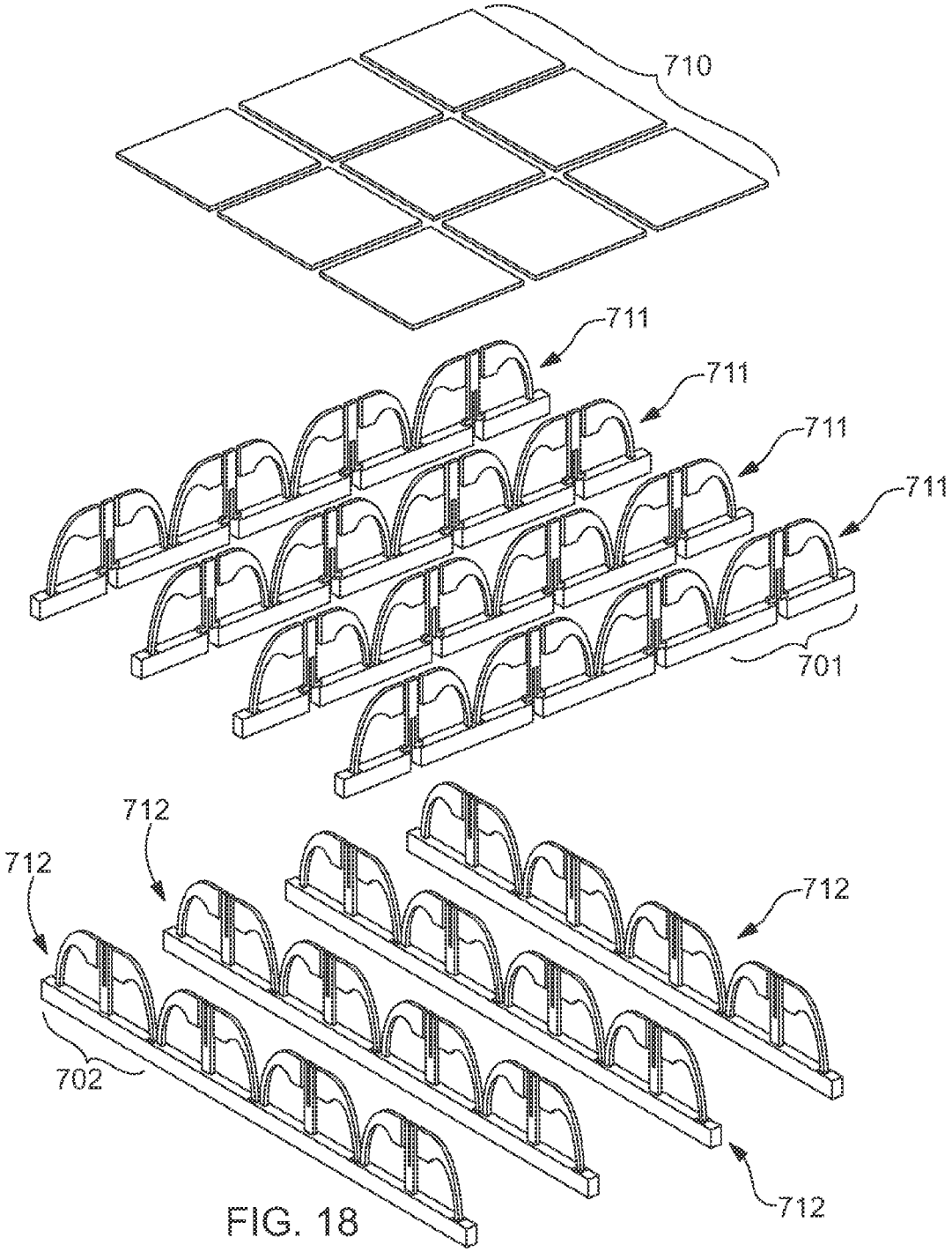
FIG. 18 schematically illustrates an isometric exploded view of arrays of antenna elements of FIGS. 17C, 17D which can slide together in egg-crate fashion along with ground plane squares/tiles.
Figure 19:
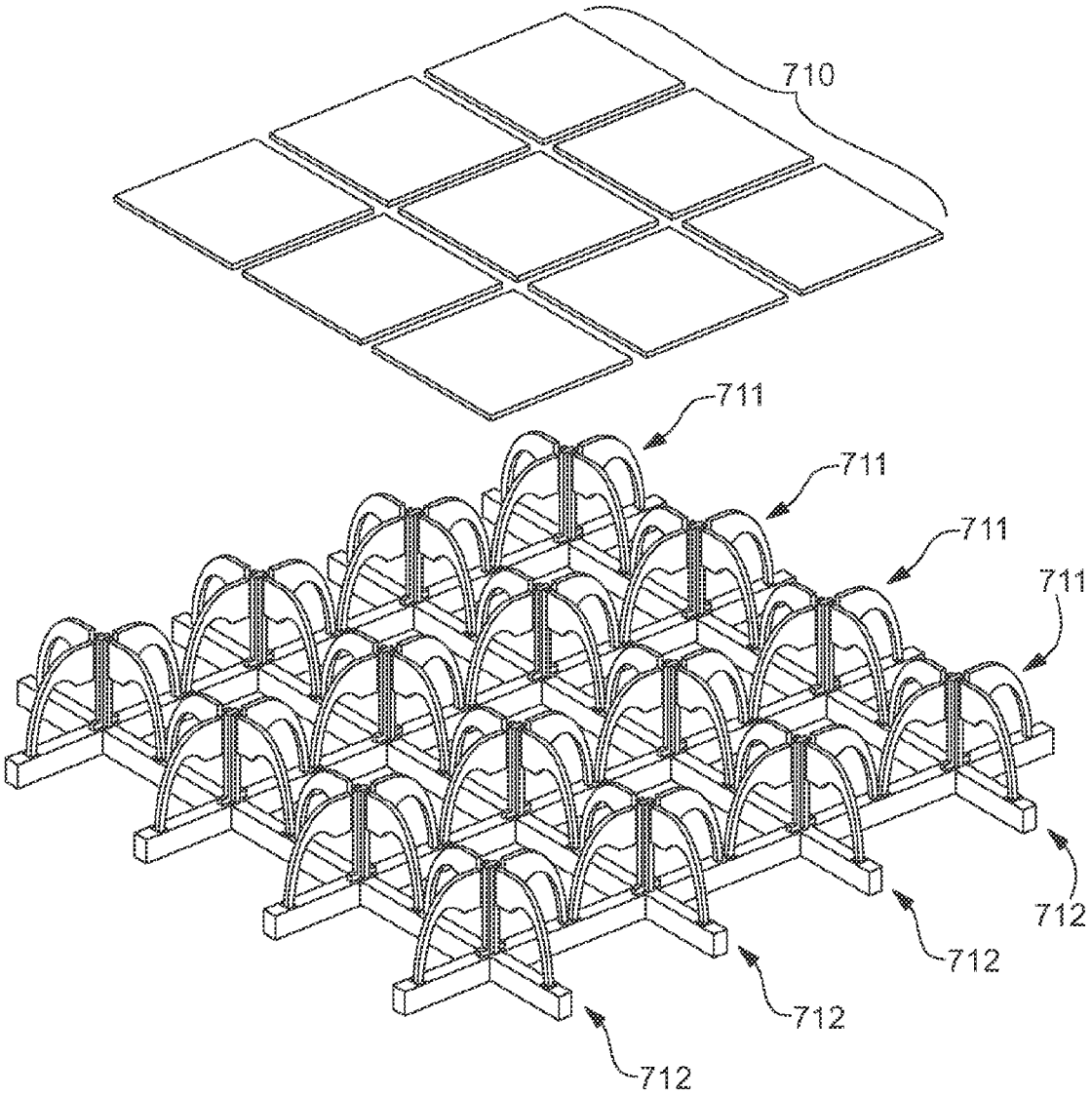
FIG. 19 schematically illustrates the array of FIG. 18 with the arrays of antenna elements slid together.
Figure 20:
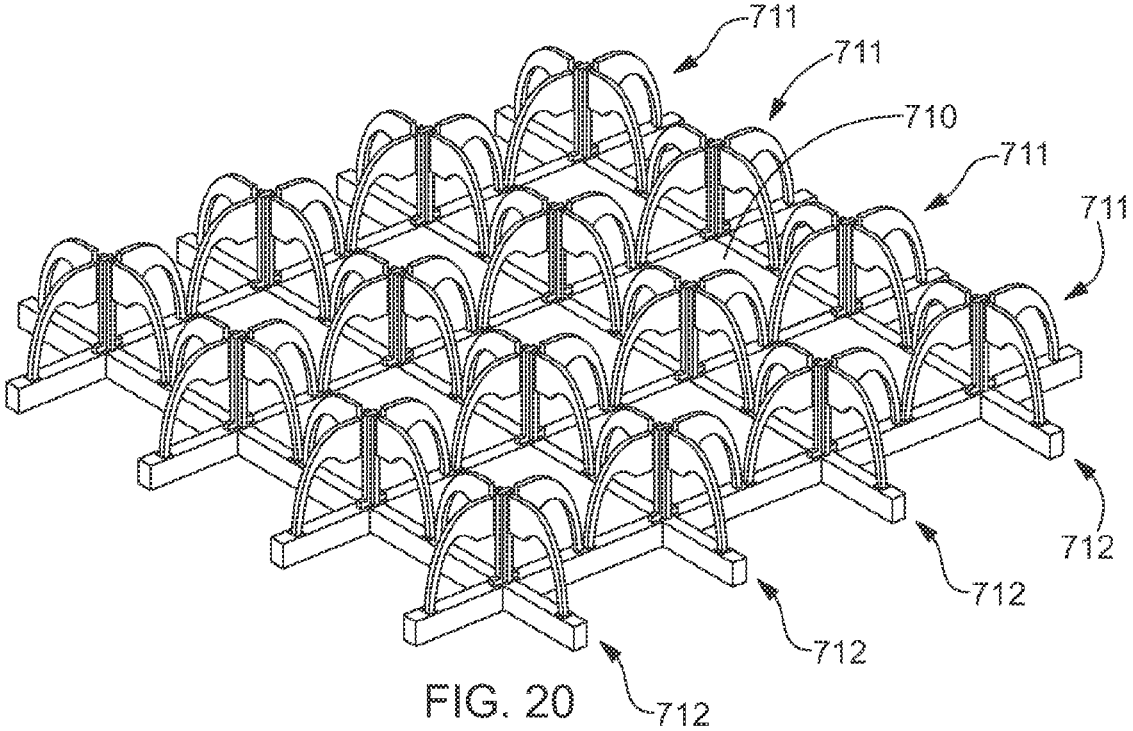
FIG. 20 schematically illustrates the array of FIG. 19 with the ground plane squares/tiles inserted in the array.

The cards 701, 702 may have respective mating slot 733, 737 configured for insertion into one another, so the cards 701, 702 may be joined to one another as indicated in FIGS. 17C, 17D. Although illustrated in a single configuration, the orientation of the mating slots could be reversed on the different cards, 701 and 702 and the performance of the array when egg crated would be similar. Each card 701, 702 may include respective dielectric bars 725, 735 disposed within respective gaps 755, 757 of the respective feed and radiator sections 720, 730. The presence of the respective dielectric bars 725, 735 help support the feed and radiator sections 720, 730, while also providing for capacitive coupling across the gap 755, 757 as indicated by the letter "C" and the symbol, ⫫, illustrated in FIG. 17D. (Again, the electrical symbol for a capacitor, ⫫, is a label and not a physical feature having that shape.) The cards 701, 702 may be provided as an array of such elements 711, 712 oriented orthogonally to one another and having slots to permit such arrays 711, 712 to be inserted into one another, FIGS. 18, 19. A grid of ground plane tiles 710 may be provided and inserted between the arrays 711, 712 to provide an assembled array, FIGS. 19, 20.

Figure 15:
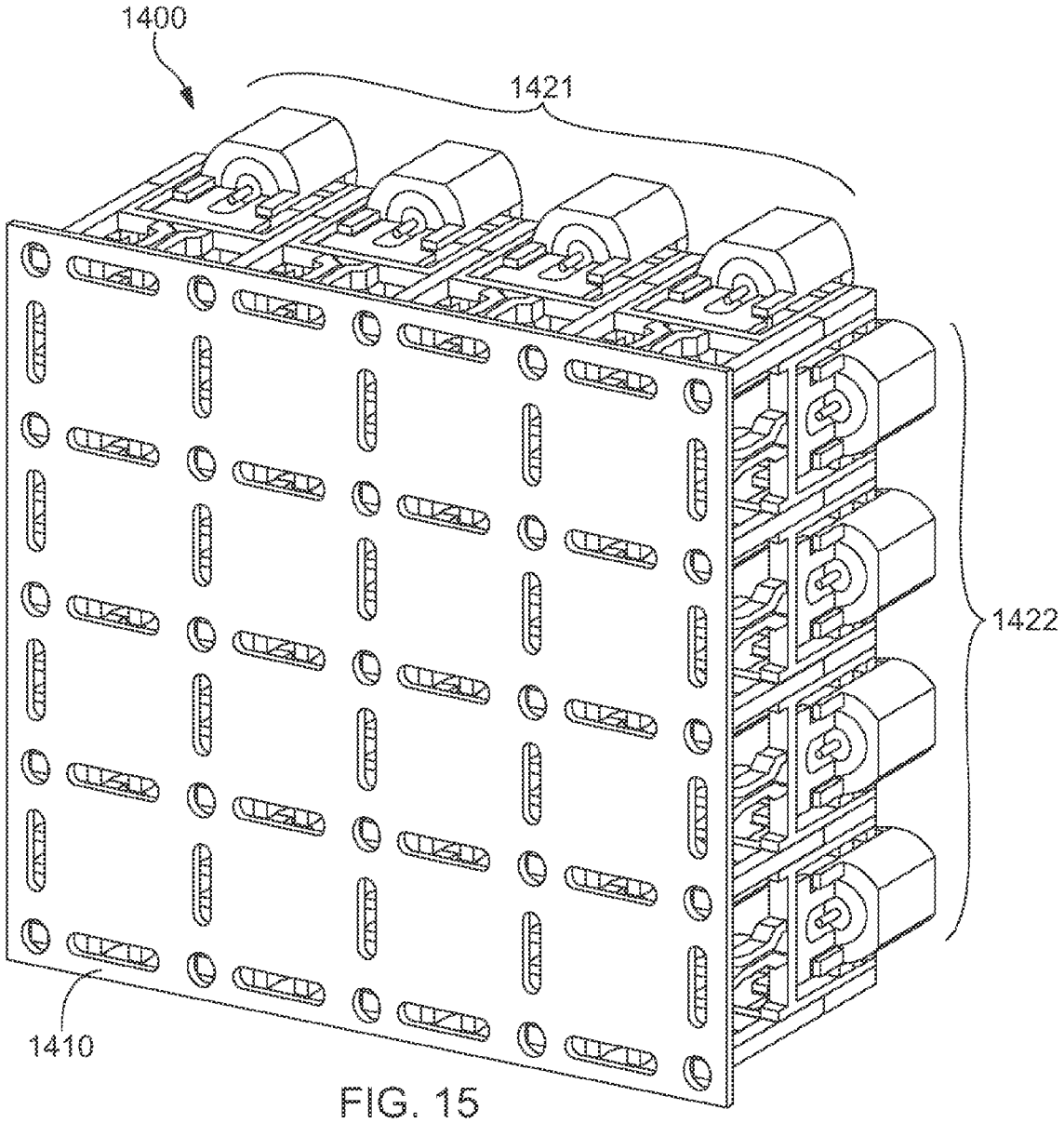
FIG. 15 schematically illustrates the array of FIG. 14 with the groupings of feed posts slid together ready for insertion into the openings of the ground plane.
Figure 16:
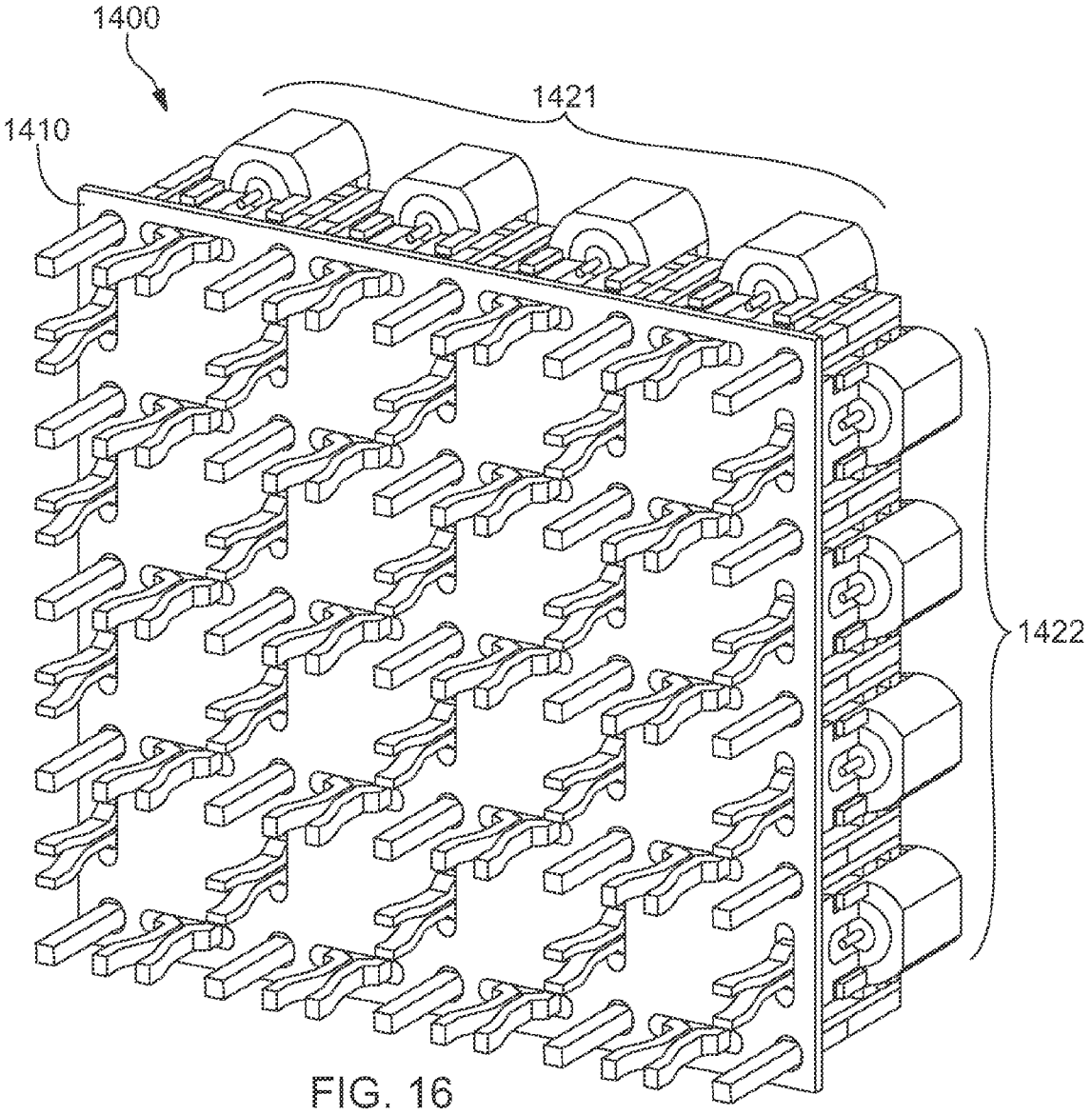
FIG. 16 schematically illustrates the array of FIG. 15 with the feed posts inserted into the openings of the ground plane.
Figure 21:
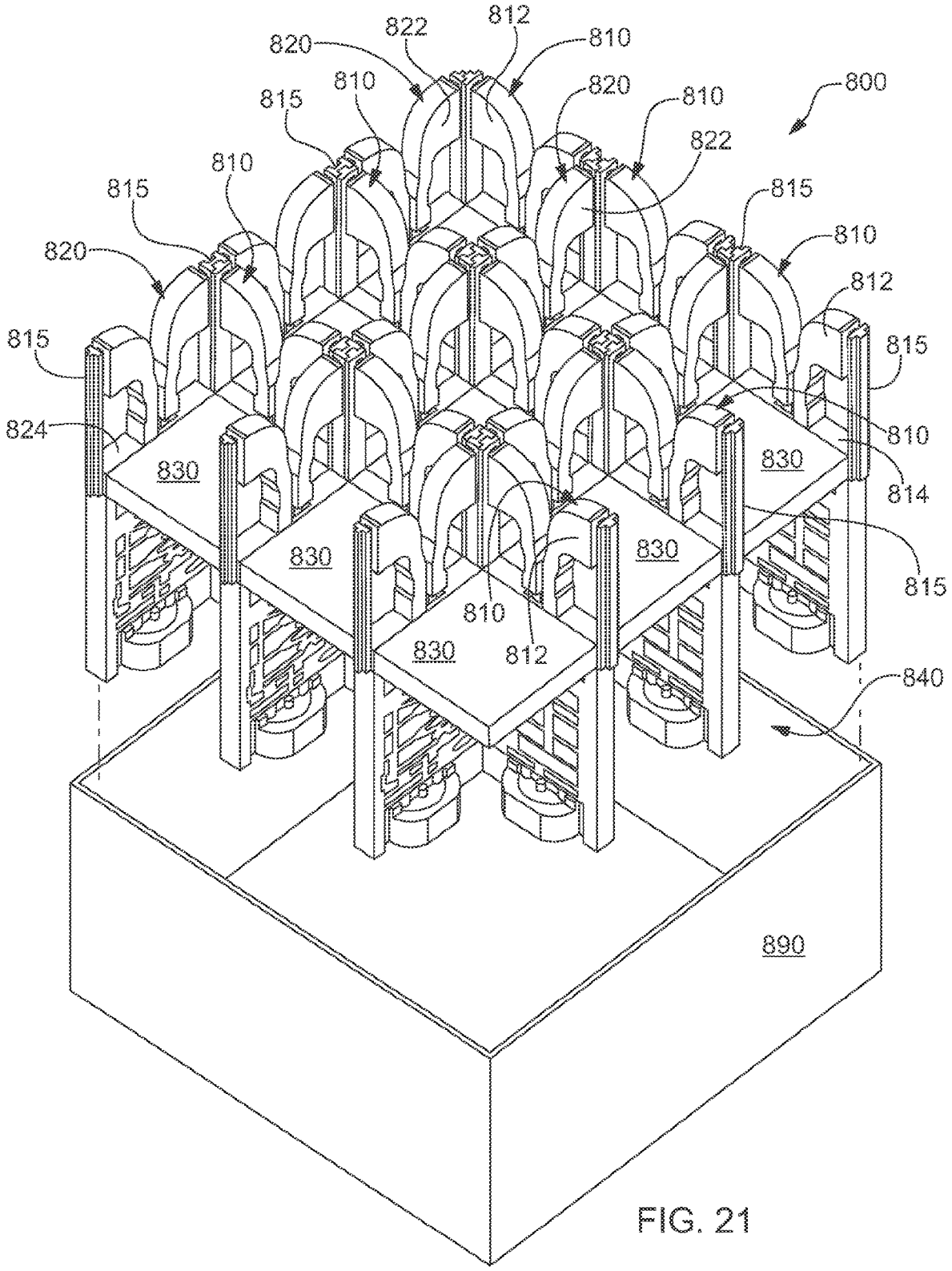
FIG. 21 schematically illustrates an isometric view of a further exemplary antenna array in accordance with the present invention having ground posts incorporated into the radiator structure and having a lower egg-crate to house the components driving the antenna.
Figure 22:
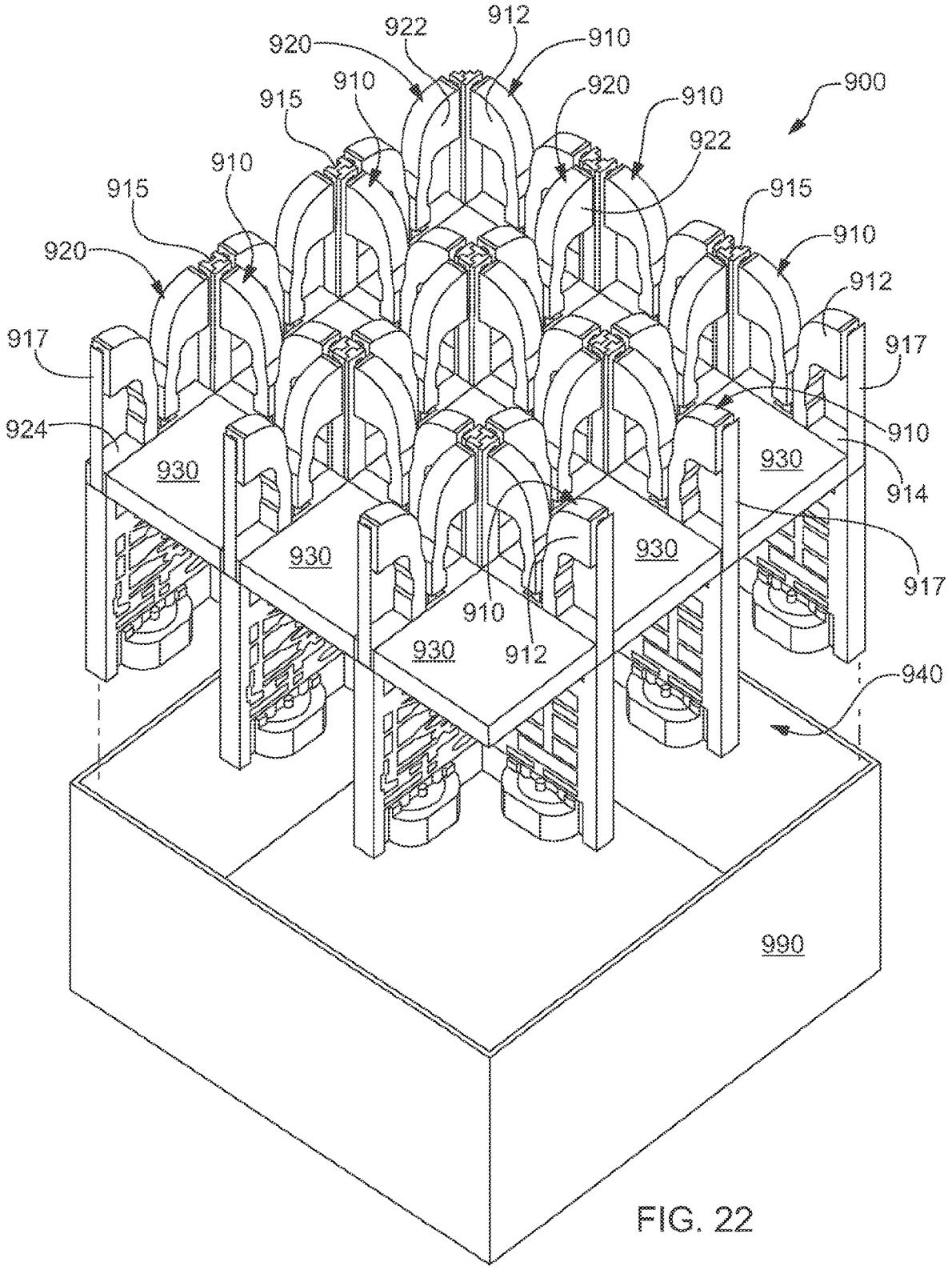
FIG. 22 schematically illustrates an isometric view of an exemplary antenna array similar to that of FIG. 21 but having portions of the ground posts omitted from the periphery of the array.

In still a further example of an antenna array in accordance with the present invention, FIGS. 21-24 schematically illustrate exemplary antenna arrays 800, 900 formed in egg-crate fashion having a plurality of horizontal polarization cards 810, 910 and vertical polarization cards 820, 920. The horizontal polarization cards 810, 910 may be disposed parallel to one another, and the vertical polarization cards 820, 920 may be disposed parallel to one another, with the horizontal and vertical polarization cards disposed perpendicular to one another and connected to one another via a plurality of ground posts 815 provided on the horizontal and vertical polarization cards at the locations where such cards intersect and join. The horizontal and vertical polarization cards 810, 820, 910, 920 may be held together by pressure, epoxy, solder or any combination of the three to form one unified assembly structure. The ground posts may have a cross-section having a generally plus shape or an I-beam shape where the protrusions look and function as dovetails, FIGS. 21, 22. Though not explicitly shown in these figures for the purposes of tiling these arrays, the ground posts could be entirely formed by cards of one polarization, as shown in FIGS. 14, 15 and 16 or using the methods shown in FIGS. 17, 18 19 and 20. Additionally, these arrays may be formed monolithically and then brought together to make arrays of arrays, as shown in FIG. 28. FIGS. 21 and 22 show how arrays of arrays are constructed and one trained in the art would not be limited by the internal details of the arrays.

The cards 810, 820, 910, 920 may include respective radiator sections 812, 822, 912, 922 and may include respective ground sections 814, 824, 914, 924, FIGS. 21, 22. A plurality of ground plane tiles 830, 930 may be disposed between the horizontal and vertical polarization cards 810, 820, 910, 920 at a location proximate and in contact with the ground sections 814, 824, 914, 924, to capture the ground planes 830, 930 in the array 800, 900. The antenna arrays 800, 900 may be driven by electronic components provided in a plurality of electronic component cards 840 disposed below the ground plane tiles 830, 930. The electronic component cards 840 may be provided in the form of an egg-crate shape that is registered to the locations of the horizontal and vertical polarization cards 810, 820, 910, 920 and epoxied in place. The antenna arrays 800, 900 may also be driven by electronic components oriented approximately parallel to the ground tiles 830, 930.

A difference between the arrays 800, 900 relates to differences in the shapes of the ground posts at the periphery of the array. In the antenna array 800, the ground posts 815 extend beyond the edge of the ground planes 830 and the electronic component cards 840, whereas in the antenna array 900 ground posts 917 disposed around the periphery of the array 900 are flat slats that fit within the shadow of the array 900 and do not extend over the edges of the ground planes 930. Although not illustrated by a figure, if the ground sections 814, 824, 830 conform to the share of the ground posts 815 in the plane perpendicular to the ground posts, it is possible for adjacent antenna arrays 800 to be inserted or removed in any order into a larger array, while the array shown in FIG. 21 must be inserted from right to left and removed from left to right when inserted and removed vertically from above. The antenna arrays in FIGS. 21 and 22 are shown as being three by three arrays of unit cells of the antenna elements, but other configurations such as 2×2, 4×4, 8×8 or more may also be implemented.

Figure 23:
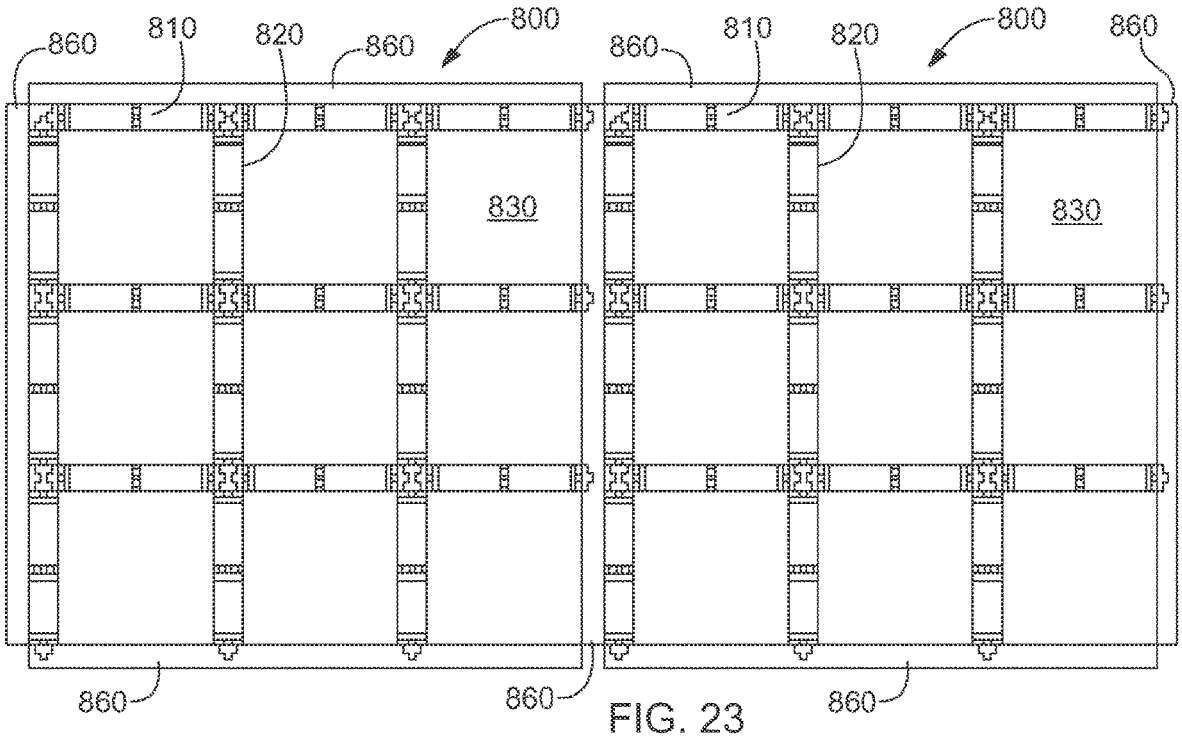
FIGS. 23 and 24 schematically illustrate top views of a plurality of arrays of FIG. 21 showing various sealing configurations.
Figure 24:
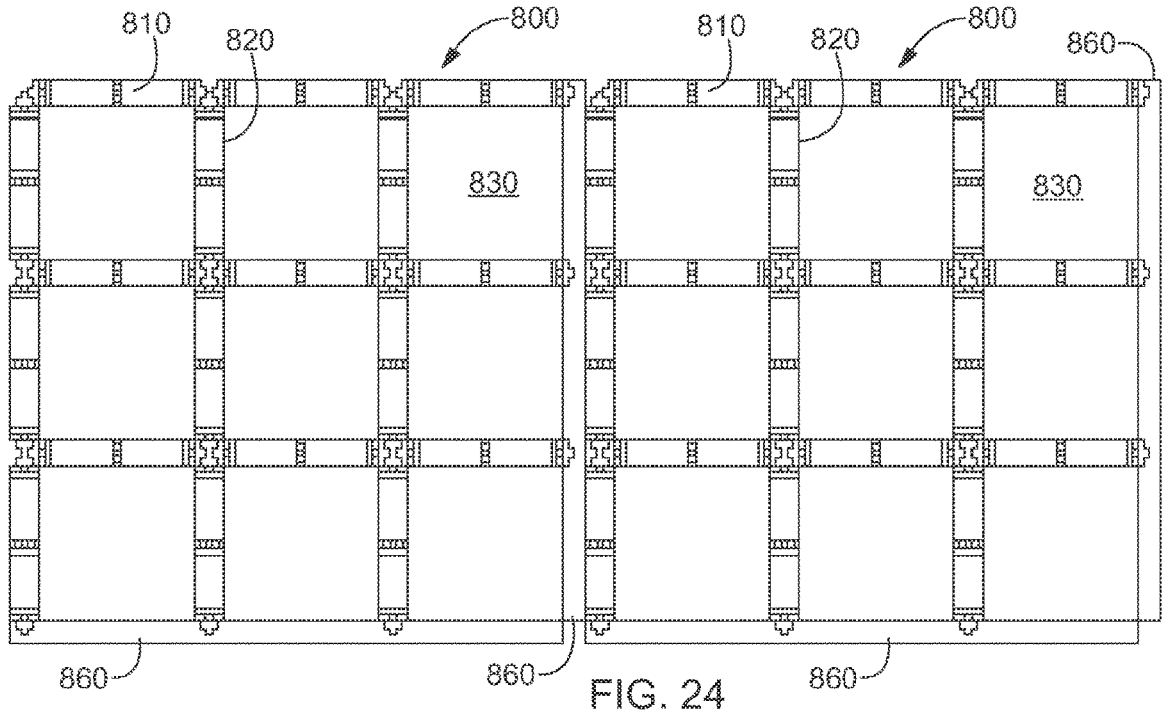
Figure 25A:
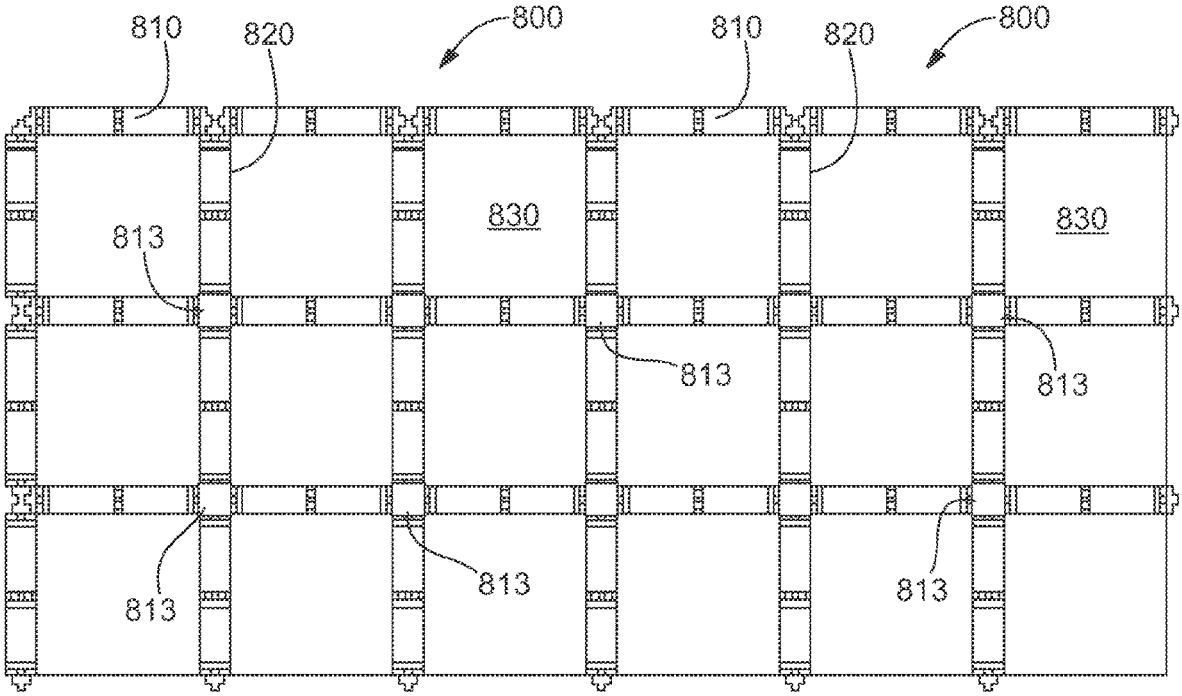
FIG. 25A schematically illustrates a top view of a plurality of arrays of FIG. 21 for tiling together using tiling caps.
Figure 25B:
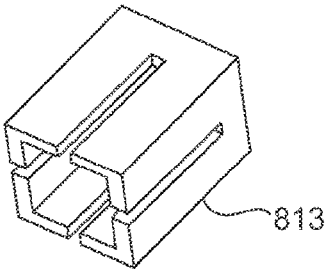
FIGS. 25B-25D schematically illustrate an exemplary tiling cap in accordance with the present invention, alone and installed on the arrays of FIG. 25A.
Figure 25C:
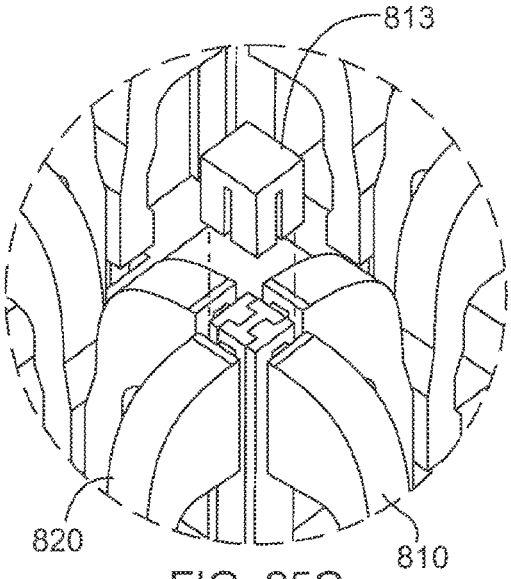
Figure 25D:
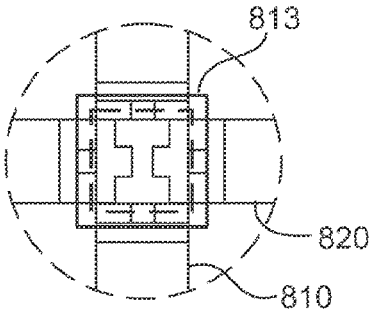
Figure 26A:
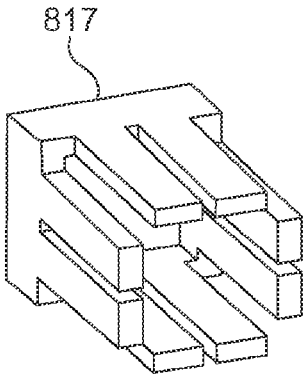
FIGS. 26A, 26B schematically illustrates an exemplary conductive tiling cap in accordance with the present invention for use in joining together the arrays of FIG. 25A.
Figure 26B:
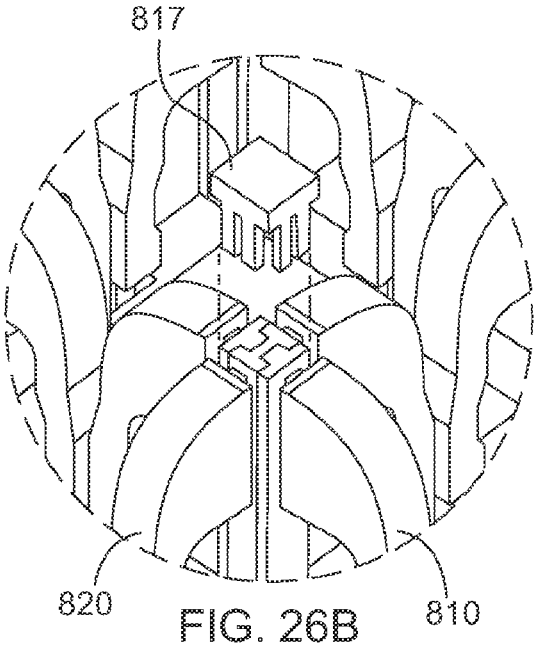
Figure 27:
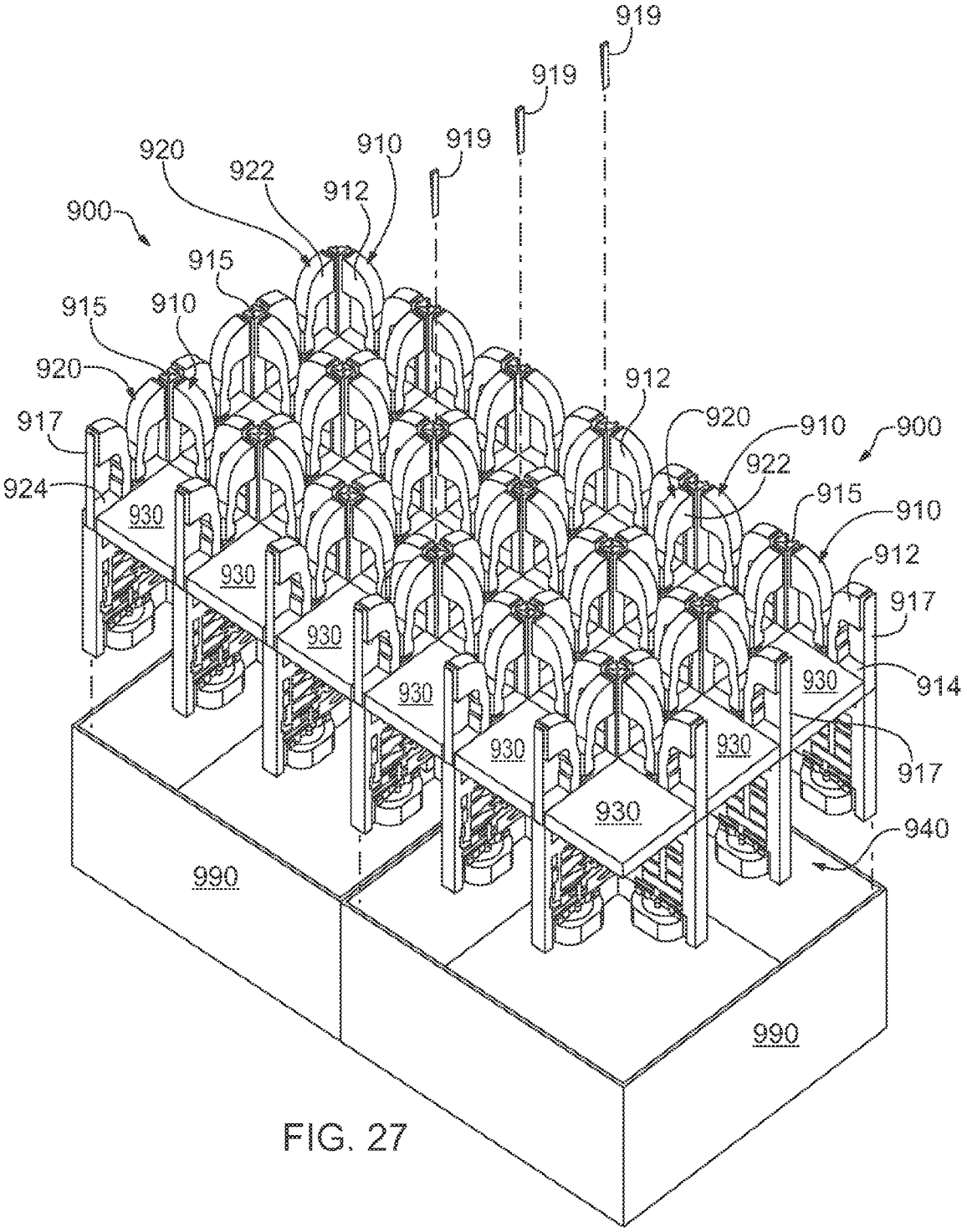
FIG. 27 schematically illustrates two subarrays of FIG. 22 with tiling pins inserted therebetween.

When connecting two or more antenna arrays 800, 900 to create a larger array, a sealing material may be desired between the edges of the arrays proximate their respective ground plane tiles 830, 930. For example, FIGS. 23, 24 schematically illustrate top views of two possibilities for providing seals 860 around the periphery of the arrays 800, where FIG. 23 shows seals 860 around all four edges of the arrays 800 and FIG. 24 shows seals 860 around only two of the four edges of the arrays 800. Although the seals 860 are shown substantially similar in width to the horizontal and vertically polarized cards, they may be a small fraction of that width in practical cases (a fifth or less the width). In addition, although each unit cell of the arrays 800 are shown as the same size, those along the outside edge may be reduced in size by approximately the width of 860 to maintain the same element pitch across arrays of arrays. A vertical skirt 890, 990 may be provided around all the sides of the electronic component cards to provide a vertical surface that may be used as a sealing surface to seal adjacent arrays 800, 900 together, FIGS. 21, 22. The seals 860 may be a compliant material that deforms to maintain antenna element pitch across multiple tiled antenna arrays 800, 900 or an epoxy, for example. In addition, the arrays 800 may be placed in direct contact along their edges and joined together using nonconductive caps 813, FIGS. 25A-25D, or conductive caps 817, FIGS. 26A, 26B. In this regard, the caps 813, 817 may be placed over the conductive ground posts 815, 915 of the horizontal and vertical polarization cards 810, 820, 910, 920. Still further, two arrays 900 may be joined via their respective vertical skirts 990, and tiling pins 919 may be inserted between adjoining ground posts 915 of separate antenna arrays 900 to electrically connect the adjoining ground posts 915, 917, FIG. 27. Another alternative to joining adjacent arrays is to use conductive epoxy or another adhesive material on the ground posts 917 of adjacent arrays in addition to connecting their respective ground planes. The skirts 990 may be separate parts which are attached to one another or a monolithic part having an opening for each array 900. An extension would be to create longer arrays of arrays or to create arrays in two dimensions or to use these arrays to tile across a surface that is not flat using the arrays as facets.

Figure 28A:
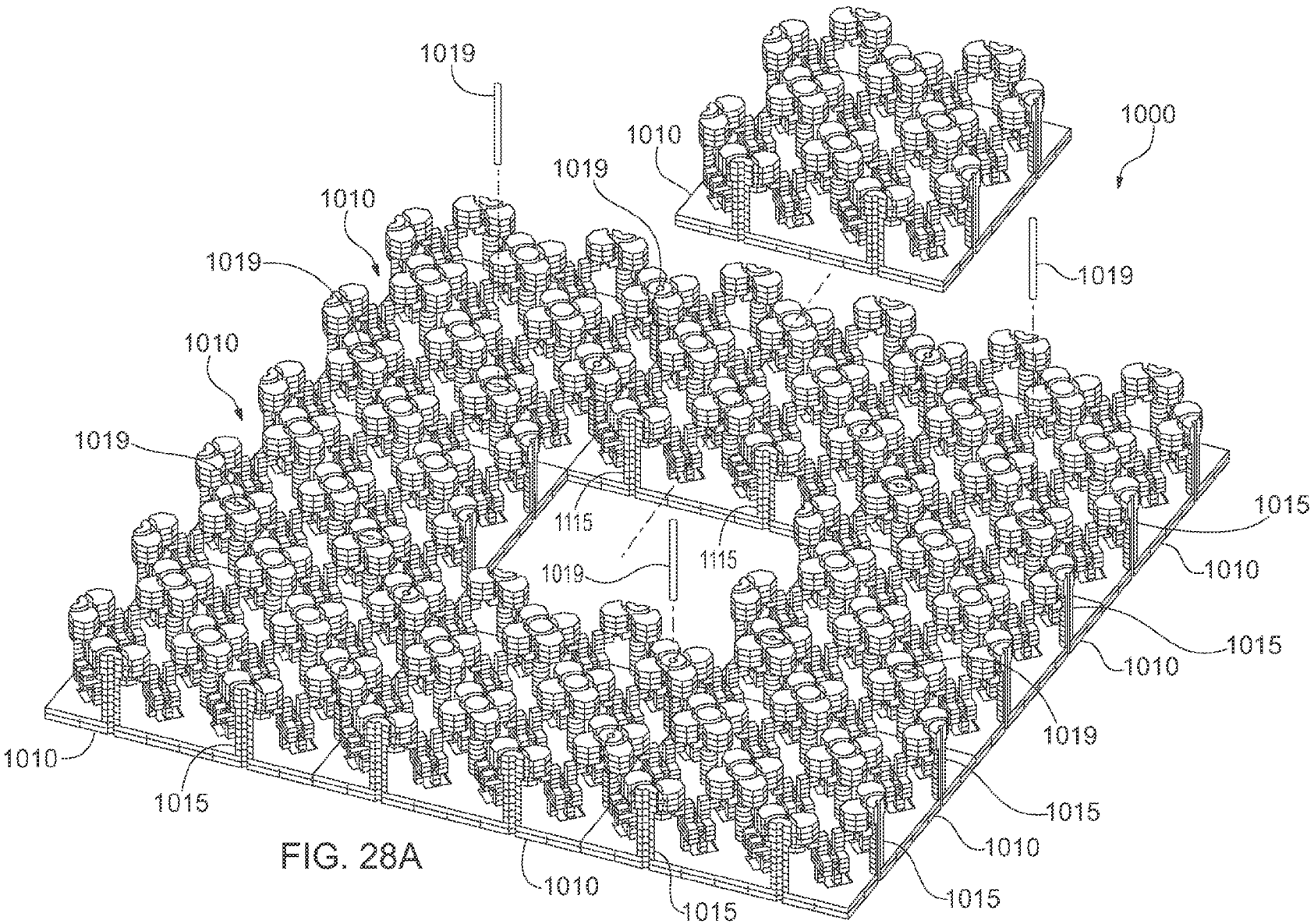
FIG. 28A schematically illustrates subarrays built by a multilayer build process and similar in some respects to those of FIGS. 9-11 and having tiling pins inserted between the subarrays.
Figure 28B:
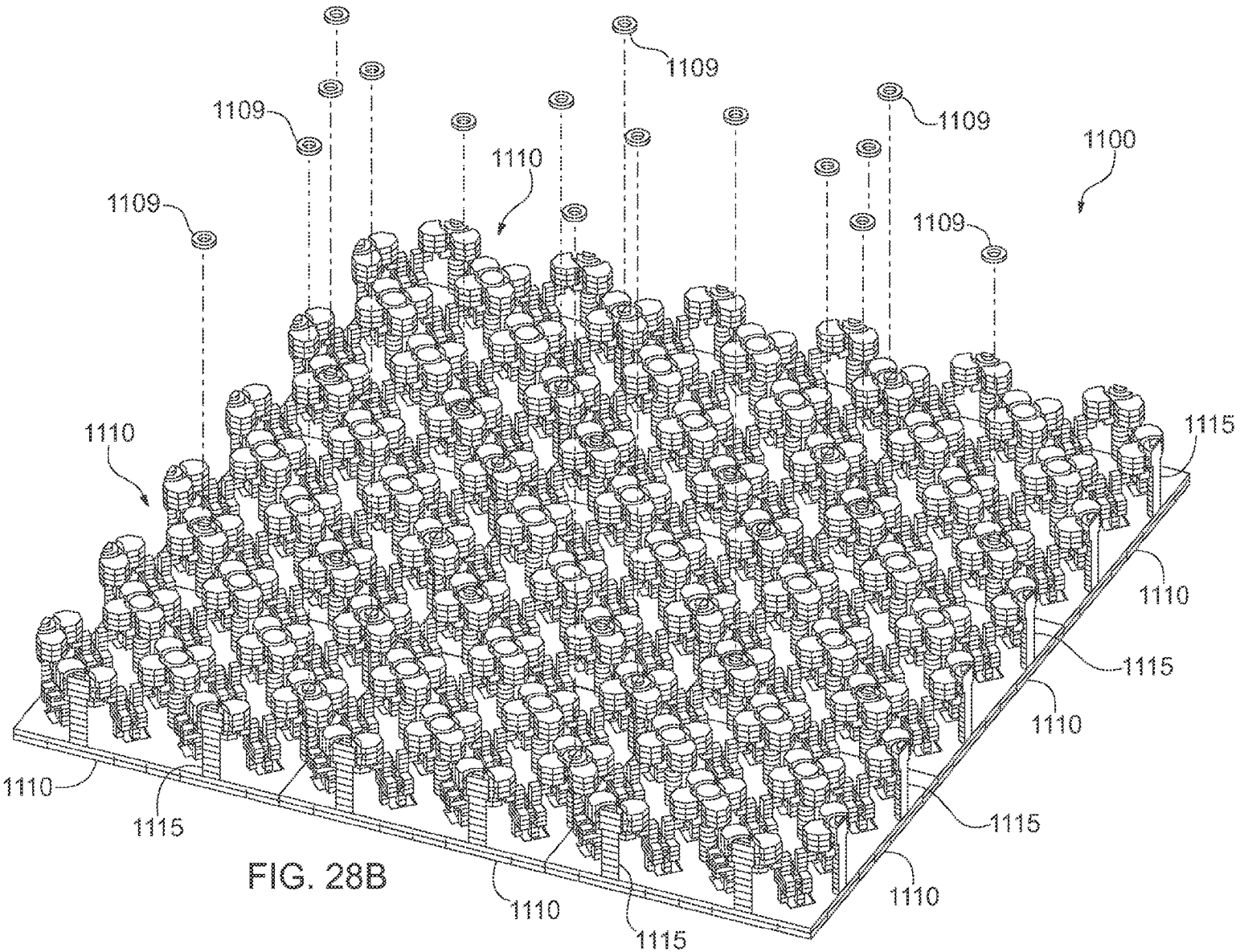
FIGS. 28B, 28C schematically illustrate subarrays built by a multilayer build process and similar in some respects to those of FIGS. 9-11 and having tiling caps disposed on adjacent subarrays.
Figure 28C:
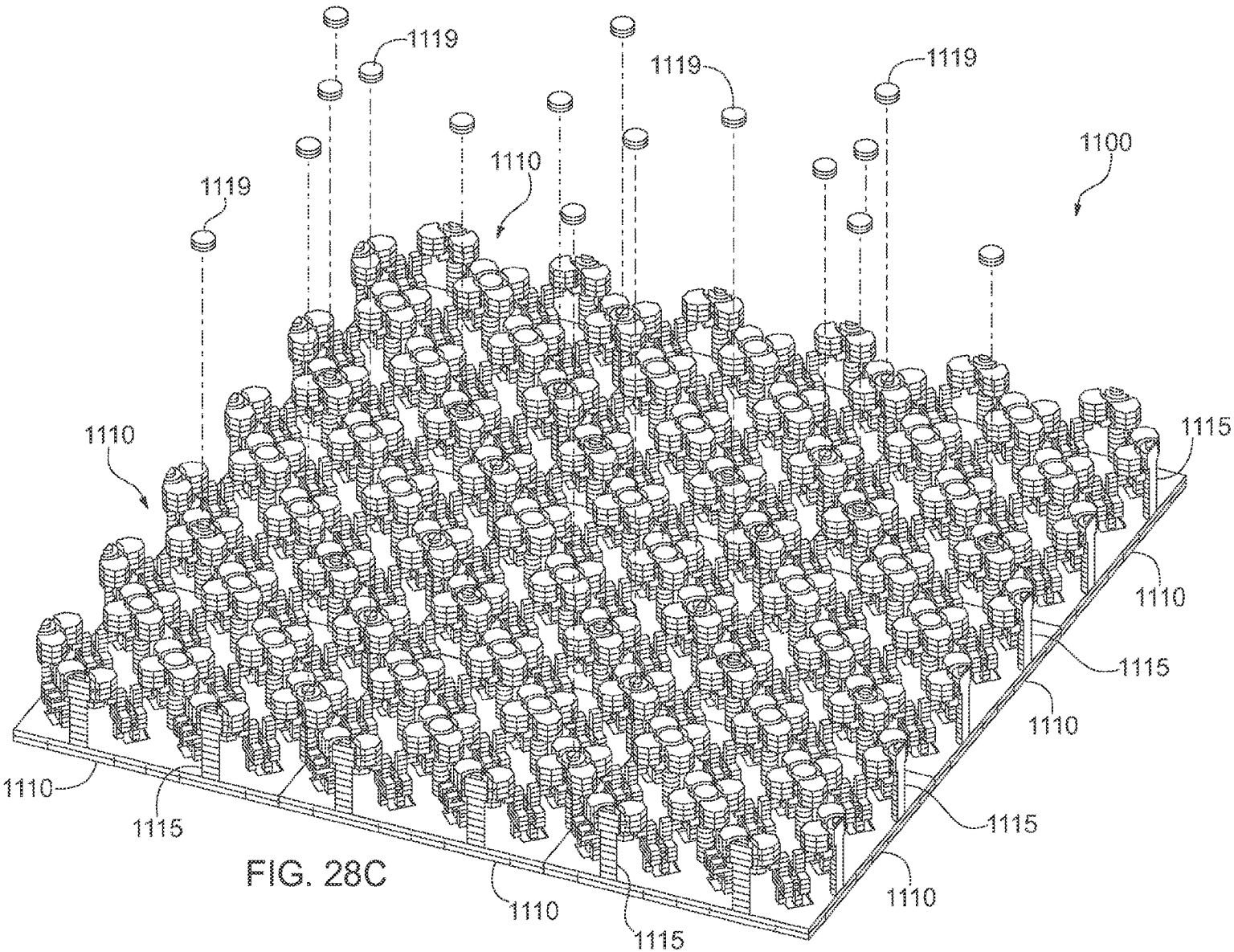

In yet another inventive aspect of the present invention, monolithically formed multilayer arrays of the types shown in FIGS. 9-11 may be tiled together, FIGS. 28A-28C. For example, a plurality of multilayer subarrays 1010, 1110, built by a multilayer build process, may be arranged on a grid to provide a larger array 1000, 1100. In one exemplary configuration, each subarray 1010 may include a plurality of ground post sections 1015 located around the periphery thereof, with the ground post sections 1015 configured to receive a tiling pin 1019 to facilitate electrical communication between adjoining ground post sections 1015 of adjacent subarrays 1010. In another exemplary configuration, each subarray 1110 may include a plurality of ground post sections 1115 located around the periphery thereof, with the ground post sections 1115 configured to receive a tiling cap 1109, 1119 to facilitate electrical communication and attach adjoining ground post sections 1115 of adjacent subarrays 1111. The tiling cap 1109 may be provided in the form of a washer or the form of a washer with a solid disc-like top, e.g., tiling cap 1119. Note that the tiling pins 1019 and tiling caps 1109, 1119 are not shown in sufficient quantity in FIGS. 28A-28C to tie together all the ground post sections 1115 that have been configured to receive the tiling pins or tiling caps to promote clarity in the drawing. Finally, note that although these antenna arrays of arrays are shown as being either constructed from egg crates or multi-layer fabrication processes, other methods of formation for the arrays such as 1100 in FIG. 28B may be used. The methods of using tiling pins or tiling caps would be equally applicable.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A tightly coupled, dipole antenna structure, comprising a ground plane and a feed section disposed thereon, the feed section having a plurality of freestanding conductive feed posts extending upwardly away from an upper surface of the ground plane, a selected first of said feed posts disposed in electrical communication with the ground plane, and a selected second of said feed posts extending through a hole in the ground plane such that the second feed post does not contact the ground plane, wherein a selected pair of the plurality of freestanding conductive feed posts contains at least one dielectric support bar extending therebetween.

2. The tightly coupled, dipole antenna structure of claim 1, wherein the plurality of freestanding conductive feed posts includes multiple layers of a conductive material.

3. The tightly coupled, dipole antenna structure of claim 1, wherein the plurality of freestanding conductive feed posts includes multiple layers of a conductive material, said layers disposed parallel to the upper surface of the ground plane.

4. The tightly coupled, dipole antenna structure of claim 1, wherein at least one of the plurality of freestanding conductive feed posts comprises a change in shape along the length thereof.

5. The tightly coupled, dipole antenna structure of claim 1, wherein the plurality of freestanding conductive feed posts and conductive ground plane form a monolithic structure.

6. A plurality of the antenna structures of claim 1 arranged on a rectilinear grid to provide an antenna array of said antenna structures.

7. The array of claim 6, wherein the array comprises a dual polarized grid of the antenna structures.

8. The array of claim 6, wherein the array comprises a single polarized grid of the antenna structures.

9. The tightly couple, dipole antenna structure of claim 1, wherein the feed section comprises a plurality of feed sections, and comprising a first plurality and a second plurality of generally planar antenna cards each card including respective ones of the plurality of feed sections, the first plurality of antenna cards having a slot disposed therein and the second plurality of generally planar cards having a mating slot disposed therein complementary to the slots of the first plurality of antenna cards, wherein a respective complementary slot of the second plurality of cards is disposed within a respective slot of the first plurality of antenna cards.

10. The tightly couple, dipole antenna structure of claim 9, wherein first and second plurality of antenna cards are oriented to provide a dual polarized antenna structure.

11. The tightly couple, dipole antenna structure of claim 1, wherein the ground plane includes a plurality of openings through which the feed posts extend.

12. A tightly coupled, dipole antenna structure, comprising:

a ground plane and a feed section disposed thereon, the feed section having a plurality of freestanding conductive feed posts extending upwardly away from an upper surface of the ground plane, a selected first of said feed posts disposed in electrical communication with the ground plane, and a selected second of said feed posts extending through a hole in the ground plane such that the second feed post does not contact the ground plane, wherein a selected pair of the plurality of freestanding conductive feed posts has a gap disposed therebetween that is sufficiently close to reduce impedance of the feed posts in the region of the feed posts proximate the gap, and at least one dielectric support bar extending between the pair within the gap.

13. A tightly coupled, dipole antenna structure, comprising a ground plane and a feed section disposed thereon, the feed section having a plurality of freestanding conductive feed posts extending upwardly away from an upper surface of the ground plane, a selected first of said feed posts disposed in electrical communication with the ground plane, and a selected second of said feed posts extending through a hole in the ground plane such that the second feed post does not contact the ground plane, wherein the ground plane is located at a first end of the plurality of freestanding conductive feed posts, and comprising a radiator section disposed in electrical communication with the plurality of freestanding conductive feed posts at a second end of the plurality of freestanding conductive feed posts, wherein the radiator section comprises circuit board patterned on an upper surface thereof with conductive radiator elements and patterned on a lower surface thereof with a conductive ground element, the conductive radiator elements and conductive ground element capacitively coupled to one another through the circuit board.

14. The tightly coupled, dipole antenna structure of claim 13, wherein the radiator section comprises multiple layers of a conductive material.

15. The tightly coupled, dipole antenna structure of claim 14, wherein the multiple layers of the radiator section are monolithically formed with the feed section.

16. The tightly coupled, dipole antenna structure of claim 13, wherein the radiator section is configured to cooperate with the feed section to provide a tightly couple dipole antenna.

17. The tightly coupled, dipole antenna structure of claim 13, wherein the feed section comprises a plurality of feed sections and the radiator section includes a plurality of radiator sections, and comprising a first plurality and a second plurality of generally planar antenna cards each card including a respective ones of the plurality of feed sections and radiator sections, the first plurality of antenna cards having a slot disposed therein and the second plurality of generally planar cards having a mating slot disposed therein complementary to the slots of the first plurality of antenna cards, wherein a respective complementary slot of the second plurality of cards is disposed within a respective slot of the first plurality of antenna cards.

18. The tightly couple, dipole antenna structure of claim 17, wherein first and second plurality of antenna cards are oriented to provide a dual polarized antenna array of tightly coupled dipoles.

19. The tightly coupled, dipole antenna structure of claim 13, wherein the radiator section comprises a cap.

20. The tightly coupled, dipole antenna structure of claim 19, wherein the cap comprises a conductive material.

21. The tightly coupled, dipole antenna structure of claim 19, wherein the cap comprises a non-conductive material.

22. The tightly coupled, dipole antenna structure of claim 13, wherein the conductive radiator elements are configured to function as dipoles.

23. The tightly coupled, dipole antenna structure of claim 13, wherein the conductive radiator elements and conductive ground element are capacitively coupled to one another with a capacitance in the range of approximately 20 fF to 50 fF across the circuit board.

24. A tightly coupled, dipole antenna structure, comprising a ground plane and a feed section disposed thereon, the feed section having a plurality of freestanding conductive feed posts extending upwardly away from an upper surface of the ground plane, a selected first of said feed posts disposed in electrical communication with the ground plane, and a selected second of said feed posts extending through a hole in the ground plane such that the second feed post does not contact the ground plane, wherein the ground plane is located at a first end of the plurality of freestanding conductive feed posts, and comprising a radiator section disposed in electrical communication with the plurality of freestanding conductive feed posts at a second end of the plurality of freestanding conductive feed posts, wherein the radiator section comprises circuit board patterned on an upper surface thereof with conductive radiator elements and patterned on a lower surface thereof with a conductive ground element, the conductive radiator elements and conductive ground element capacitively coupled to one another through the circuit board, wherein the conductive ground element has arms configured in a generally plus shape, and the conductive coupling between the ground element and conductive radiator elements extends along the arms of the conductive ground element.

25. A tightly coupled, dipole antenna structure, comprising a ground plane and a feed section disposed thereon, the feed section having a plurality of freestanding conductive feed posts extending upwardly away from an upper surface of the ground plane, a selected first of said feed posts disposed in electrical communication with the ground plane, and a selected second of said feed posts extending through a hole in the ground plane such that the second feed post does not contact the ground plane, wherein the ground plane is located at a first end of the plurality of freestanding conductive feed posts, and comprising a radiator section disposed in electrical communication with the plurality of freestanding conductive feed posts at a second end of the plurality of freestanding conductive feed posts, and a dielectric superstrate disposed over the radiator section and having apertures extending therethrough to communicate with the radiator section.

* * * * *